US011248745B2

(12) United States Patent
Nozawa

(10) Patent No.: US 11,248,745 B2
(45) Date of Patent: Feb. 15, 2022

(54) REINFORCEMENT TECHNOLOGY FOR SUPER-HIGH PRESSURE TANK REINFORCED BY CARBON FIBER

(71) Applicant: Tsukasa Nozawa, Tokyo (JP)

(72) Inventor: Tsukasa Nozawa, Tokyo (JP)

( * ) Notice: Subject to any disclaimer, the term of this patent is extended or adjusted under 35 U.S.C. 154(b) by 20 days.

(21) Appl. No.: 16/824,965

(22) Filed: Mar. 20, 2020

(65) Prior Publication Data

US 2020/0217455 A1 Jul. 9, 2020

Related U.S. Application Data

(63) Continuation-in-part of application No. 15/725,820, filed on Oct. 5, 2017, now Pat. No. 10,864,684.

(51) Int. Cl.
*F17C 1/06* (2006.01)

(52) U.S. Cl.
CPC ..... *F17C 1/06* (2013.01); *F17C 2201/0109* (2013.01); *F17C 2203/012* (2013.01); *F17C 2203/0624* (2013.01); *F17C 2203/0636* (2013.01); *F17C 2209/2154* (2013.01); *F17C 2209/221* (2013.01); *F17C 2209/23* (2013.01); *F17C 2223/036* (2013.01)

(58) Field of Classification Search
CPC ..... F17C 1/06; F17C 2209/23; F17C 2209/2154; F17C 2201/0109; F17C 2203/0636; F17C 2203/0624; F17C 2203/012; F17C 2209/221; F17C 2223/036; F17C 2203/0609; F17C 2201/0123; F17C 2209/234; F17C 2209/2127; F17C 2203/0619; F17C 2203/0643; F17C 2209/227; F17C 2203/0646; F17C 2203/067; F17C 1/00; F17C 2201/056; F17C 2201/058; F17C 2205/0397; F17C 2203/0604; F17C 2203/0648

See application file for complete search history.

(56) References Cited

U.S. PATENT DOCUMENTS

| | | | | |
|---|---|---|---|---|
| 3,537,416 A | | 11/1970 | Cowles | |
| 3,641,230 A | | 2/1972 | Jenks | |
| 4,063,999 A | | 12/1977 | Wade | |
| 4,476,988 A | | 10/1984 | Tanner | |
| 5,174,466 A | | 12/1992 | Matyja | |
| 5,441,219 A | * | 8/1995 | Rauscher, Jr. | B29C 53/822 220/562 |
| 5,556,601 A | * | 9/1996 | Huvey | B29C 53/805 156/172 |

(Continued)

FOREIGN PATENT DOCUMENTS

| | | |
|---|---|---|
| EP | 1520683 B1 | 2/2008 |
| JP | 2001-287290 A | 10/2001 |

(Continued)

*Primary Examiner* — Kareen K Thomas
(74) *Attorney, Agent, or Firm* — Juan Carlos A. Marquez; Marquez IP Law Office, PLLC

(57) ABSTRACT

The present invention is directed to a reinforcement method for a cylindrical high-pressure tank reinforced by FRP prepreg bandage, totally. For that purpose, this invention developed the manufacturing process for the internal metallic tank assembly where its diameter is comparatively large. It is effective for lightening weight of a high-pressure tank.

16 Claims, 11 Drawing Sheets

(56) References Cited

U.S. PATENT DOCUMENTS

| | | | | |
|---|---|---|---|---|
| 5,651,474 | A * | 7/1997 | Callaghan | B29C 70/088 220/565 |
| 5,822,838 | A * | 10/1998 | Seal | B23K 15/0046 29/469.5 |
| 6,186,356 | B1 * | 2/2001 | Berkley | F17C 1/00 220/304 |
| 6,357,439 | B1 * | 3/2002 | Cook | A62B 9/00 128/205.22 |
| 6,638,348 | B2 | 10/2003 | Kuriiwa et al. | |
| 7,137,526 | B2 | 11/2006 | Sakaguchi et al. | |
| 7,566,376 | B2 | 7/2009 | Matsuoka | |
| 8,006,841 | B2 | 8/2011 | Bontemps et al. | |
| 8,917,809 | B2 | 12/2014 | Nozawa | |
| 2004/0040969 | A1 * | 3/2004 | DeLay | F17C 1/06 220/586 |
| 2004/0145079 | A1 | 7/2004 | Lin et al. | |
| 2005/0076995 | A1 * | 4/2005 | Yasui | D04C 1/06 156/148 |
| 2005/0077643 | A1 * | 4/2005 | Matsuoka | F17C 1/06 264/103 |
| 2006/0096993 | A1 * | 5/2006 | Takashima | F17C 1/06 220/588 |
| 2009/0071930 | A1 * | 3/2009 | Sato | F17C 1/06 215/380 |
| 2013/0049256 | A1 * | 2/2013 | Tani | B29C 49/20 264/249 |
| 2017/0167661 | A1 * | 6/2017 | Yang | B29C 53/562 |
| 2018/0003346 | A1 * | 1/2018 | Chung | B29C 65/48 |

FOREIGN PATENT DOCUMENTS

| | | | |
|---|---|---|---|
| JP | 4862975 | B2 | 1/2012 |
| JP | 2017101763 | A | 6/2017 |
| WO | 01/57354 | A2 | 8/2001 |
| WO | 2010/057089 | A1 | 5/2010 |

* cited by examiner

REINFORCEMENT TECHNOLOGY FOR SUPER-HIGH PRESSURE TANK REINFORCED BY CARBON FIBER

This application is a continuation-in-part application of U.S. patent application Ser. No. 15/725,820 filed Oct. 5, 2017, of which the entire contents thereof are hereby incorporated by reference.

BACKGROUND OF THE INVENTION

Field of the Invention

This invention is concerned with reinforcement technology for a super-high pressure tank where the tank has a comparatively large-scale cylindrical internal tank made of metal and reinforced by carbon fiber.

Description of the Prior Art

U.S. patent application Ser. No. 15/725,820 shows an idea of an internal metallic tank assembly for a honeycomb structural high-pressure set tank and a manufacturing process where a cylindrical tank made of laminar stainless steel is reinforced by a carbon fiber prepreg in the form of a long and slender bandage specifically wound around the cylindrical tank.

The basic reinforcement method for reinforcing a high-pressure tank using a bandage of carbon fiber prepreg is disclosed in U.S. patent application Ser. No. 15/725,820 and embodies the following two concepts:

(1) It separately deals with axial stress and circumferential stress.

1. The invention addresses axial stress by the following method: When a long FRP prepreg bandage is wrapped to draw spiral S-character at both ends of the tank, the surface of the tank is completely covered with the FRP prepreg bandage. The long FRP prepreg bandage wrapping the tank is completely consecutive. As a result, a hoop stress is generated in the FRP prepreg bandage. Hoop stress is a tension stress. A FRP prepreg bandage endures tension stress well, as one of its main characteristics. However, this method cannot resist stress in the direction of the circumference.
2. The invention addresses stress of the circumference by the following method:

When a long FRP prepreg bandage is rolled around the tank, the straight surface of the tank is reinforced with the FRP prepreg bandage. The long FRP prepreg bandage wrapping the tank is completely consecutive. As a result, hoop stress is generated in the FRP prepreg bandage. Hoop stress is a tension stress. The FRP prepreg bandage endures the tension stress. However, the domed parts at both ends of the tank are not reinforced in this structure.

(2) The S-character spiral winding and the circumference rolling of the FRP prepreg bandage solves many of the stress issues, but not all. Some middle material that mediates between the S-character spiral winding and the circumference rolling is necessary. One aspect of the invention to address the issue of a mediating middle material is the incorporation of a domed molding that was newly designed as part of the invention. The domed molding is manufactured from a thermoplastic resin and it has three purposes:

1. The domed molding strengthens the domed part that is not reinforced by the method of rolling the bandage around the cylinder.

2. The domed molding prevents the connection fitting from being pushed out from the metallic tank by internal pressure.
3. The domed molding increases the number of rolling of FRP prepreg bandages resisting the circumference stress of high-pressure tank.

Problems the Invention is Solving

It turned out that Domed Molding was not effective when internal pressure exceeds 90 MPa. And, when the diameter of an internal cylindrical tank exceeds 100 mm, reinforcement with the carbon fiber prepreg bandage becomes difficult. The reason is that the transformation of Domed Molding cannot adhere to the transformation of an internal tank by super-high pressure of larger tank because the thickness of molding is too thick to endure the compression stress of 90 MPa or more. The high-pressure tank, which had been produced in the method of U.S. patent application Ser. No. 15/725,820, exploded from the weakest area in the dome part of cylinder tank when internal pressure exceeded 90 MPa.

The weakest area in the hemisphere part of cylindrical tank is well known. It is not a domed center but the outside edge of hemisphere. The hemisphere part of cylindrical tank is reinforced only by the carbon fiber bandage of S-character spiral winding. In other words, the hemisphere part is not reinforced by circumference rolling bandage around the cylindrical tank. Further, reinforcement by S-character spiral winding has a characteristic where the carbon fiber prepreg bandage of S-character spiral winding concentrates on a center of dome. The domed outside edge, which is the weakest area of cylindrical tank, becomes sparse. In a word, the hemisphere part of cylindrical tank is not reinforced by the carbon fiber bandage of circumference rolling and it is not evenly reinforced by the bandage of S-character spiral winding. It is not easy to reinforce the hemisphere part of a cylindrical tank efficiently. This problem remarkably grows according to when the diameter of an internal tank becomes large.

In general, it is impossible to repeat the S-character spiral winding and the circumference rolling alternately, because a stair difference is generated between the bandage of S-character spiral winding and the bandage of circumference rolling. In a present technology, when it wants to guarantee the strength of outside edge of the hemisphere part of a cylindrical tank, S-character spiral winding bandage can do nothing but wind around the internal tank thick and thick. If it wants to manufacture a high-pressure tank of a larger diameter, S-character spiral winding bandage grows thicker and thicker. As a result, the weight of high-pressure tank increases needlessly. Bad to worse, when the bandage of 5-character spiral winding becomes thick, the carbon fiber prepreg concentrates on a central part of dome. As the result, the structural strength of heat-cured carbon prepreg becomes weakened. When it wants to manufacture a high-pressure tank of a large diameter, the decentralization of S-character spiral winding bandage is indispensable. If it wants to reinforce a high-pressure tank by carbon fiber with the method U.S. patent application Ser. No. 15/725,820, it is necessary to invent something new that takes the place of Domed Molding.

When long and slender bandage is winding around the end of a cylindrical tank with S-character spiral, it is preferable that both ends of the cylindrical tank are hemisphere. And, convex prop should stand at a domed center.

This is described in U.S. patent application Ser. No. 15/725,820. This invention advocates designing a multi-step prop on the center of hemisphere.

The concentration of the bandage of S-character spiral winding can be distributed by adopting the multi-step method. However, it is impossible to control the thickness of the piled bandage that concentrates around each prop. Uncontrollable gaps are caused at the borderline of props in the multi-step prop method. It is necessary to bury each gap smoothly with something filler material. The filler material is preferable to be something where carbon fiber powder or glass fiber powder is mixed with a thermoplastic adhesive. Now, it can be substituted with metal powder mixed with a thermoplastic adhesive. The metallic powder that can be obtained now is an iron powder of 75 microns in the diameter.

In addition, the Domed Molding prevents a connection assembly from being pushed out from the metallic tank by internal pressure. Moreover, it is necessary to deal with the leakage from connection fitting and connection tube because the internal pressure exceeds 100 MPa or more in leakage examination. Strength and rigidity are necessary for connection fitting and connection tube where they endure the high pressure of 100 MPa or more. It is not possible to weld such solid connection parts directly to a cylinder tank that is made of lamina stainless steel. This invention should solve various problems of intertwining complexly.

SUMMARY OF THE INVENTION

The new invention described herein is directed to improving an idea where "U.S. patent application Ser. No. 15/725,820" shows to manufacture an internal metallic tank assembly for a super-high pressure tank where its diameter is comparatively large and a manufacturing process, therefore.

First of all, strength and rigidity are necessary for connection fitting and connection tube where the connection fitting and connection tube endure super-high pressure of 100 MPa or more. When the connection fitting and the connection tube are manufactured from the stainless steel, the fitting and the tube can endure the internal pressure of 100 MPa or more. Actually, the fitting and the tube that endure 100 MPa are marketed in general. However, in that case, the thickness of the connection fitting becomes so thick and rigid that it becomes difficult to weld the fitting to the internal tank made of lamina stainless steel.

The procedure that welds a thick and rigid connection fitting to a hemisphere cap of lamina cylindrical stainless tank is as follows.

(1) A dome-shaped thick and solid stainless base plate, which is opening of hole to center, is manufactured.
(2) A connection fitting, which is marketed as a high-pressure joint, is welded into the hole.
(3) A dome-shaped stainless plate of medium thickness, which is opening of hole to center, is manufactured. The hole of the medium thick plate is a little smaller than outer diameter of the first dome-shaped stainless plate.
(4) The dome-shaped stainless plate of (1) and (3) are connected to match the center line of the hole and they are welded.
(5) The process of (3) and (4) is repeated if necessary.
(6) Finally, the dome-shaped stainless plate (1) is welded to the hemisphere cap of lamina stainless cylindrical tank like the stairs.

Thick and rigid connection fitting can be welded to a lamina stainless tank without difficulty by this procedure where dome-shaped metal plate thickness is gradually thinned.

Next, this invention describes a reinforcement method of the hemisphere part of a large-scale cylindrical tank where the Domed Molding of "U.S. patent application Ser. No. 15/725,820" cannot reinforce effectively. Hemisphere of a cylindrical tank is reinforced only by 5-character spiral winding bandage. In another word, the hemisphere part is not reinforced by circumference rolling bandage around the cylindrical tank. And, the reinforcement by 5-character spiral winding has the characteristic where the carbon fiber prepreg bandage concentrates on a center of hemisphere. In a word, hemisphere part of cylindrical tank is not reinforced by circumference rolling bandage and is not evenly reinforced by S-character spiral winding bandage.

It is true a simply consecutive S-character spiral winding cannot reinforce the hemisphere part evenly. However, if S-character spiral winding is divided several steps from the outside of the radius toward the center of hemisphere, concentration of carbon fiber prepreg bandage is divided to several steps. When this method is achieved, it is possible to reinforce the hemisphere part of cylindrical tank almost evenly even if its diameter becomes large. However, there are some problems that should be overcome in this method.

The following conditions are necessary to achieve the S-character spiral winding.

(1) The shape of tank is cylindrical and both its ends are domed convex.
(2) A prop of cylindrical shape stands up at the center of the convex dome of the tank.
(3) The cylindrical prop is manufactured in integrated or welded with a thick and rigid base plate for connection fitting.

The condition of (1) and (3) is automatically satisfied with "The procedure that welds a thick and rigid connection fitting to a hemisphere cap of lamina cylindrical stainless tank". It is necessary to make one or more convex props, which stand at the center of the hemisphere part of cylindrical tank like domed stairs. Fortunately, condition (2) is included in "The procedure that welds a thick and rigid connection fitting to a hemisphere cap of lamina cylindrical stainless tank". Because the hemisphere CAP of lamina stainless tank and one or more dome-shaped stainless plates are already welded like stairs. However usually, the difference of the domed plates, which are welded like stairs, cannot be used as prop. Because the shape of bead welded like the stairs is a slope. It is preferable to shave off this slope squarely to be a prop of S-character spiral winding.

Another problem remains in the stairs of S-character spiral bandage. The problem is that the bandage of carbon fiber prepreg, which is winding around the prop of stainless plate stair, cannot bury a gap between the prop and the S-character spiral bandage completely. The gap between the stairs prop and the S-character spiral-winding bandage is very little. However, when this gap is left alone, a kink is generated in the carbon fiber prepreg. Carbon fiber is strong to a tension stress, but it is weak to kink. The gap between stair prop and 5-character spiral-winding bandage should be buried completely.

Ideally, it is desirable to bury this gap with a paste where a powder of carbon fiber or a glass fiber is mixed with a thermoplastic bonding agent. Because the paste that is the mixture of thermoplastic bonding agent and powder of carbon or glass fiber is a soft paste when it is heated a little. Cutting down the paste with a file is easy, because the paste becomes solid at room temperature. And, it is merged with the carbon fiber prepreg by heat-treatment. However, such a filler paste is not marketed. We have manufactured a compound of the thermoplastic resin and a metallic powder. The metallic powder that can be obtained now is an iron powder of 75 microns in the diameter. When the amount of metallic powders increases, the volume change when melting becomes small. However, the viscosity of the paste becomes hard. It is preferable to process the paste to a cylinder shape, and to bury the gap while melting the paste bar with handy heating device. Temperature for melting does not change.

There is one more problem to be solved. Both "U.S. patent application Ser. No. 15/725,820" and new invention deal with the axial stress and the circumference stress separately. In this respect, the new invention is the same as "U.S. patent application Ser. No. 15/725,820". However, when the axial stress and the circumference stress are treated separately, a discontinuous difference is generated between the bandage of circumference rolling and the bandage of S-character spiral winding. The bandage of circumference rolling is only rolled on a straight line of 5-character spiral-winding bandage. "U.S. patent application Ser. No. 15/725,820" has overcome this problem by Domed Molding. However, new invention has abolished Domed Molding. Therefore, this problem remains in the new invention.

This invention is concerned with reinforcement for a super-high pressure tank where the tank has a metallic cylindrical internal tank of large scale reinforced by FRP. Generally, the basic method to manufacture a super-high pressure tank reinforced with FRP prepreg is as follows.

(1) The shape of an internal tank of super-high pressure is preferable to be cylindrical.
(2) The shape of the ends of the internal tank is preferable to be domed.
(3) It is preferable to make the internal tank by metal because a metallic tank prevents the gas of high pressure from penetrating the wall.
(4) A bandage of FRP prepreg that reinforces a metallic internal tank is preferable than a filamentous filament, in the work efficiency However, it is impossible to roll around a cylindrical internal tank uniformly with a wide bandage. Therefore, the initial high-pressure tank was reinforced by not a wide bandage but a thin round filament. However, it takes time for reinforcement by thin filament too much. To improve the work efficiency, "U.S. patent application Ser. No. 15/725,820" was invented.

However, "U.S. patent application Ser. No. 15/725,820" was not enough as the reinforcement method. S-character spiral-winding bandage of "U.S. patent application Ser. No. 15/725,820" cannot evenly reinforce the hemisphere end caps of internal cylindrical tank. The number of winding of FRP prepreg increases more and more, when the diameter of a high-pressure tank becomes large. As the result, the weight of a high-pressure tank increases without bounds. In addition, when the thickness of the FRP prepreg bandage becomes thick, the bandage of the FRP prepreg cannot be uniform. An unsubstantial part and a condensed part are generated in the pile of the FRP prepreg bandage. In a word, reinforcement technology and lightening technology of a metallic internal tank reinforced with FRP prepreg bandage are completely the same.

In this invention, the internal tank is manufactured from lamina stainless steel. The reason is that the internal tank is not only a high-pressure gasholder but also a pressurizing device for the FRP prepreg bandage. The details are described in "U.S. patent application Ser. No. 15/725,820". And, it is effective for the lightening technology because the weight density of stainless steel is the largest in the material that composes a high-pressure tank. It is not easy to weld a thick and solid connected fitting to laminar stainless steel. This invention has already shown the procedure for welding a solid and rigid connection part to lamina stainless steel tank.

In this invention, S-character spiral-winding bandage is divided several steps from outside to the center of dome. And, the gap between stair prop and the S-character spiral-winding bandage is buried with a paste of a mixture of thermoplastic bonding agent. It becomes possible to reinforce the hemisphere part of cylindrical tank continuously and evenly, where the diameter of cylindrical tank is comparatively large. However, in general, the strength of FRP prepreg will be decreased, when the FRP prepreg is too thick accumulated in the same direction. It is preferable that the direction of FRP prepreg bandage is alternately changed.

In general, it is impossible to do the S-character spiral winding and the circumference rolling continuously because the circumference rolling bandage is ended at the domed line of S-character spiral winding bandage. As the result, a stair difference is generated between S-character spiral winding bandage and circumference rolling bandage. It is necessary to bury the stair difference smoothly with some loading materials because the stair difference is sheer edge compared with the gap between stair prop and S-character spiral winding bandage.

The solution of this problem is the same as the gap between S-character spiral winding bandage and stair prop. It is desirable to smooth the stair difference with a paste where a powder of carbon fiber, a glass fiber and metal powder are mixed with a thermoplastic bonding agent. Because the paste that is the mixture of thermoplastic bonding agent and powder of carbon, glass fiber and metal powder is a soft paste when it is heated a little. Cutting down the paste with a file when it is cooled is easy, because the paste becomes solid at room temperature. And, it is merged with the carbon fiber prepreg by heat-treatment.

However, such filler paste where a powder of carbon fiber, a glass fiber and metal powder are mixed with a thermoplastic bonding agent is not marketed. We have manufactured a compound of the thermoplastic resin and a metallic powder. The metallic powder that can be obtained now is an iron powder of 75 microns in the diameter. When the amount of metallic powders increases, the volume change by melting becomes small. However, the viscosity of the paste becomes hard. It is preferable to process the paste to a long cylinder shape, and to bury the gap while melting the paste bar with handy heating device. Ideally, it is desirable to manufacture the molding filler, which buries the stairs difference between S-character spiral winding bandage and circumference rolling bandage, with the compound of a thermoplastic resin and a metallic powder. In that case, a small gap is generated between the molding and the circumference-rolling bandage. It is possible to bury the gap by melting the paste bar with handy heating device. The molding filler looks like the Domed Molding of "U.S. patent application Ser. No. 15/725,820". However, the molding filler of this invention is much smaller than that of Domed Molding of "U.S. patent application Ser. No. 15/725,820". Temperature for melting does not change.

Domed Molding of "U.S. patent application Ser. No. 15/725,820" prevents the connected fitting from being pushed out from the tank by internal pressure. However, Domed Molding is abolished in this invention. Domed Molding is bound to the cylindrical tank with the bandage of S-character spiral winding. In this invention, a dome-shaped thick and solid stainless base plate where a connected fitting is welded has already manufactured at "The procedure that welds a thick and rigid connection fitting to a hemisphere cap of lamina cylindrical stainless tank". This domed-shape base plate takes the role of Domed Molding. This base plate is bound to cylindrical tank by the bandage of S-character spiral winding. The principle is the same as "U.S. patent application Ser. No. 15/725,820".

DESCRIPTION OF THE PREFERRED EMBODIMENT

The embodiments of the present invention will be described herein below in conjunction with the above-described drawings. Referring to the attached drawings as follows, a concrete execution of the reinforcement method of a cylindrical super-high pressure tank in which its hemisphere ends are reinforced by stairs S-character spiral-winding bandage is explained.

Figure 1:
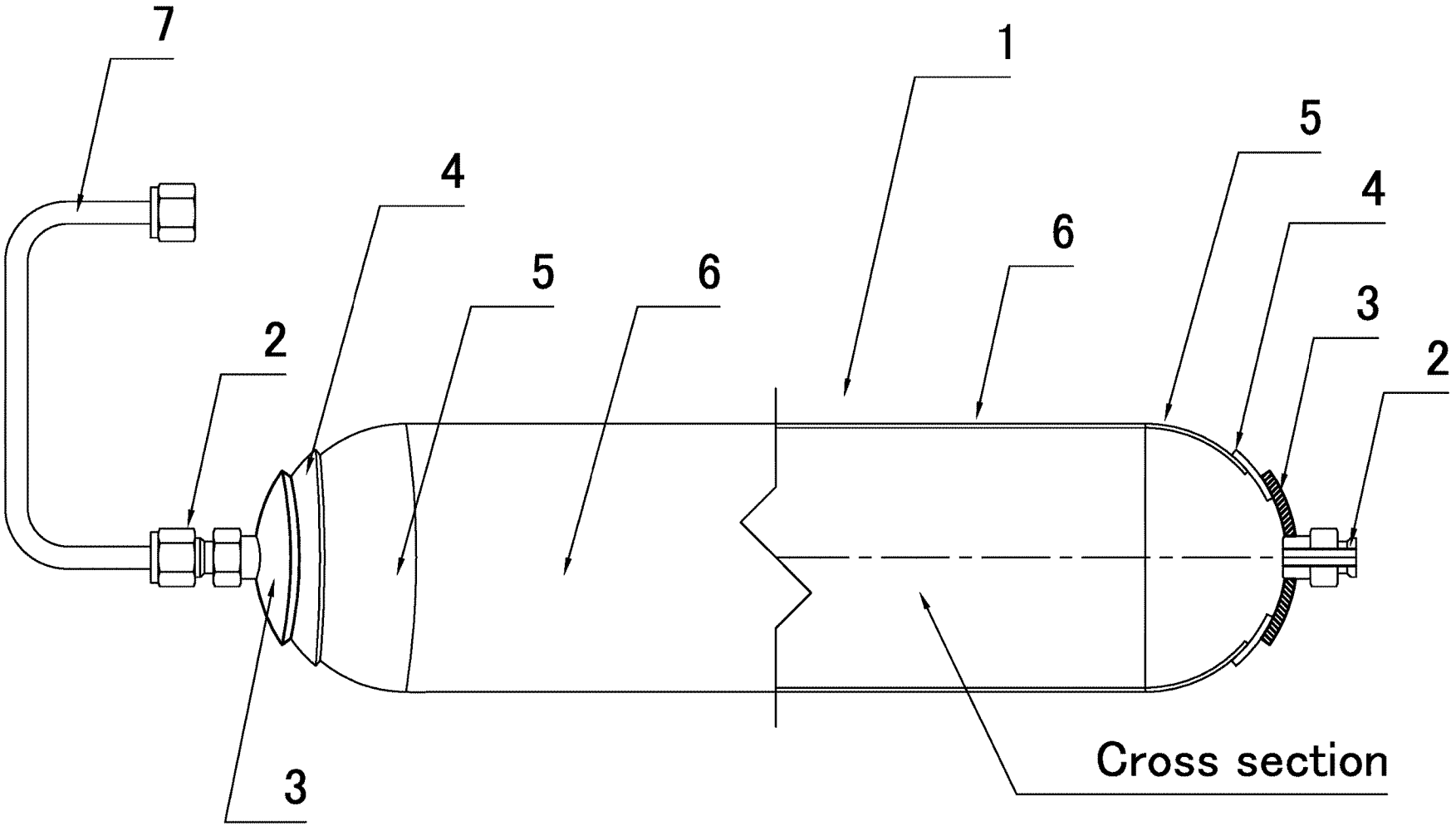
FIG. 01 shows a concept chart of MetallicTankAssembly (1) using the references of (2) ConnectionFitting, (3) DomedFittingBase, (4) DomedMiddleBase, (5) DomedCap, (6) StraightCylinder, and (7) ConnectionTube.

FIG. 01 shows a concept chart of MetallicTankAssembly (1). The MetallicTankAssembly (1) is composed of ConnectionFitting (2), DomedFittingBase (3), DomedMiddleBase (4), DomedCap (5), StraightCylinder (6), and ConnectionTube (7). Airtight is demanded to MetallicTankAssembly (1).

ConnectionFitting (2) is made of the stainless steel, the aluminum alloy, and magnesium alloys, etc. ConnectionFitting (2) is designed so that it is able to endure the high pressure of 100 MPa or more. ConnectionFitting (2) is solid, rigid, and strong and its wall thickness is thick. ConnectionFitting (2) is welded to the center of DomedFittingBase (3). The centerline of ConnectionFitting (2) and DomedFittingBase (3) is corresponding. ConnectionFitting (2) is connected with ConnectionTube (7). Airtight is demanded to the welding.

DomedFitting Base (3) is made of the stainless steel, the aluminum alloy, and magnesium alloys, etc. DomedFittingBase (3) is domed metal plate. DomedFittingBase (3) is solid, rigid, and strong and its plate thickness is thick. A penetration hole is open in the center of DomedFitting Base (3). ConnectionFitting (2) is welded into the central penetration hole of DomedFittingBase (3). DomedFittingBase (3) is welded on DomedMiddleBase (4). The centerline of ConnectionFitting (2), DomedFittingBase (3) and DomedMiddleBase (4) is corresponding. Airtight is demanded to the welding.

DomedMiddleBase (4) is made of the stainless steel, the aluminum alloy, and magnesium alloys, etc. DomedMiddleBase (4) is domed metal plate. The thickness of DomedMiddleBase (4) is thinner than the thickness of DomedFittingBase (3). However the thickness of DomedMiddleBase (4) is thicker than the thickness of DomedCap (5). A penetration hole is open in the center of DomedMiddleBase (4). Size of the penetration hole in the center of DomedMiddleBase (4) is smaller than the outer diameter of DomedFittingBase (3). DomedFittingBase (3) is welded on the central penetration hole of DomedMiddleBase (4). DomedMiddleBase (4) is welded on DomedCap (5). The centerline of ConnectionFitting (2), DomedFittingBase (3), DomedMiddleBase (4) and DomedCap (5) is corresponding. Airtight is demanded to the welding.

DomedCap (5) is made of the stainless steel, the aluminum alloy, and magnesium alloys, etc. DomedCap (5) is domed metal plate. The thickness of DomedCap (5) is thinner than the thickness of DomedMiddleBase (4). The thickness of DomedCap (5) and StraightCylinder (6) is almost same. A penetration hole is open in the center of DomedCap (5). Size of the penetration hole in the center of DomedCap (5) is smaller than the outer diameter of DomedMiddleBase (4). Outer size of DomedCap (5) is same to the outer diameter of StraightCylinder (6). DomedCap (5) is welded to StraightCylinder (6). The centerline of ConnectionFitting (2), DomedFittingBase (3), DomedMiddleBase (4), DomedCap (5) and StraightCylinder (6) is corresponding. Airtight is demanded to the welding.

StraightCylinder (6) is made of the stainless steel, the aluminum alloy, and magnesium alloys, etc. StraightCylinder (6) is cylindrical metal. The thickness of StraightCylinder (6) is thin for the purpose of weight reducing. The thickness of StraightCylinder (6) and DomedCap (5) is almost same. Outer size of StraightCylinder (6) is same to the outer diameter of DomedCap (5). DomedCap (5) and StraightCylinder (6) are welded. The centerline of ConnectionFitting (2), DomedFitting Base (3), DomedMiddleBase (4), DomedCap (5) and StraightCylinder (6) is corresponding. Airtight is demanded to the welding.

Figure 2:
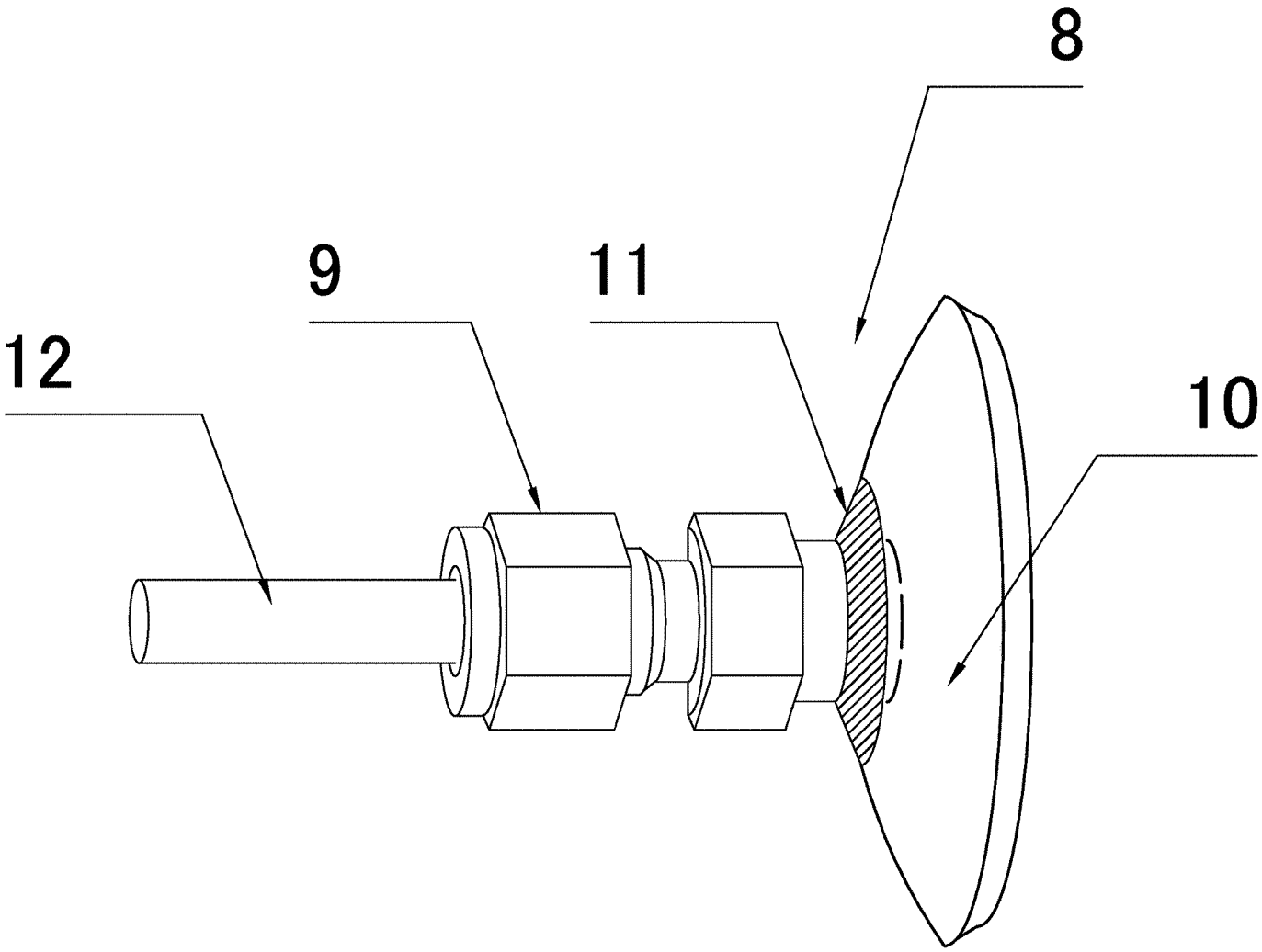
FIG. 02 shows a concept chart of ConnectionFittingAssembly (8) using the references of (9) ConnectionFitting, (10) DomedFittingBase, (11) WeldingBead, and (12) ConnectionTube.

FIG. 02 shows a concept chart of ConnectionFittingAssembly (8). ConnectionFittingAssembly (8) is composed of ConnectionFitting (9), DomedFitting Base (10), WeldingBead (11), and ConnectionTube (12).

ConnectionFitting (9), DomedFittingBase (10) and ConnectionTube (12) are the same as ConnectionFitting (2), DomedFittingBase (3) and ConnectionTube (7) shown in the FIG. 01.

WeldingBead (11) is a welding bead of ConnectionFitting (9) and DomedFittingBase (10). ConnectionFitting (9) and ConnectionTube (12) are generally marketed as a fitting and tube for the welding. ConnectionFitting (9) is high strength, rigid and solid. ConnectionFitting (8) is welded to the center of DomedFittingBase (10). As for WeldingBead (11), it is possible to weld inside of DomedFittingBase (10). Airtight is demanded to the welding.

Figure 3:
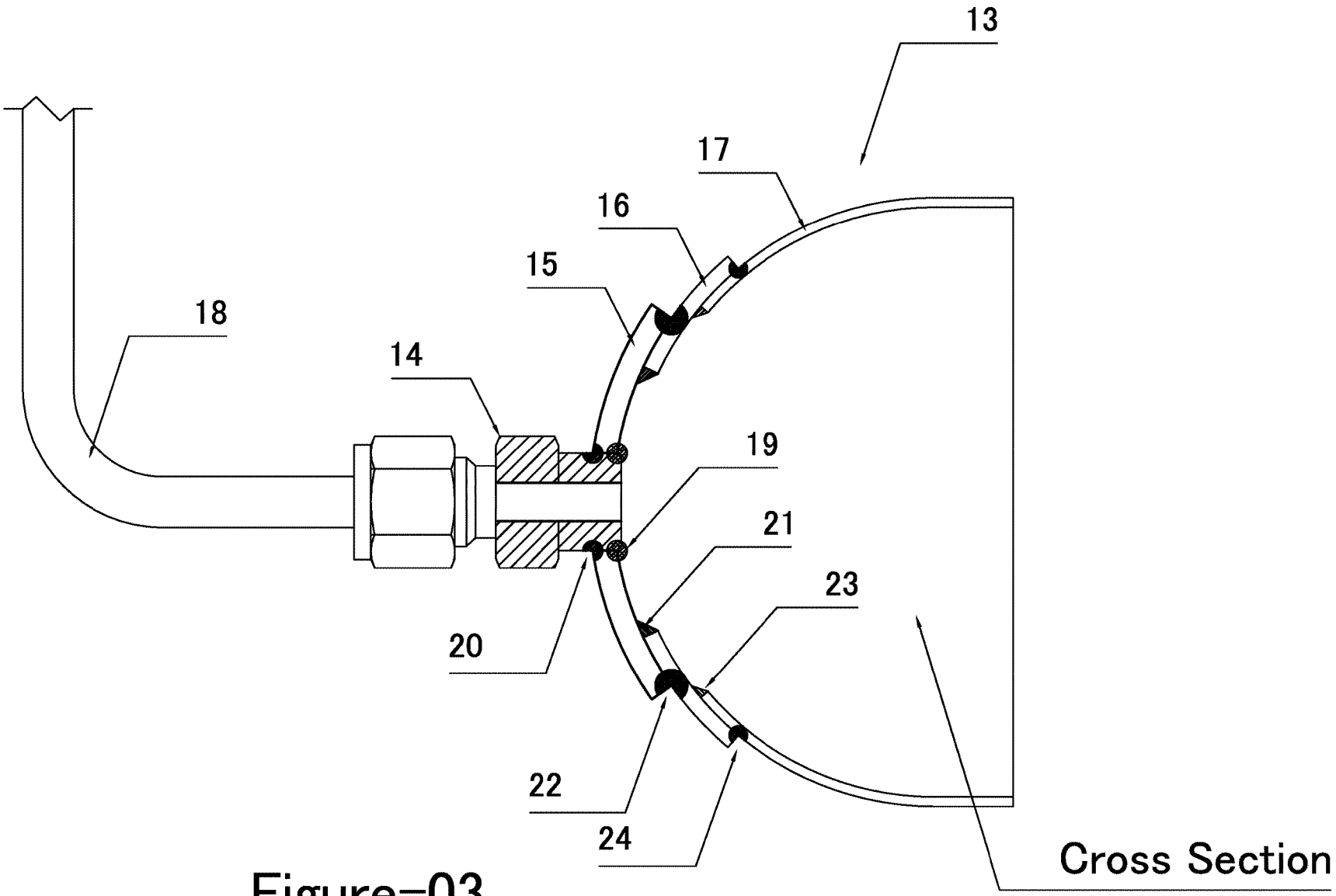
FIG. 03 shows a concept chart of TankCapAssembly (13) by cross section using the references of (14) ConnectionFitting, (15) DomedFitting Base, (16) DomedMiddleBase, (17) DomedCap, (18) ConnectionTube, (19) WeldingBead-A, (20) WeldingBeadVerticallyCut-A, (21) WeldingBead-B, and (22) WeldingBeadVerticallyCut-B, (23) WeldingBead-C and (24) WeldingBeadVerticallyCut-C.

FIG. 03 shows a concept chart of TankCapAssembly (13). TankCapAssembly (13) is composed of ConnectionFitting (14), DomedFittingBase (15), DomedMiddleBase (16), DomedCap (17), ConnectionTube (18), WeldingBead-A (19), WeldingBeadVerticallyCut-A (20), WeldingBead-B (21), WeldingBeadVerticallyCut-B (22), WeldingBead-C (23) and WeldingBeadVerticallyCut-C(24).

ConnectionFitting (14), DomedFittingBase (15), DomedMiddleBase (16), DomedCap (17) and ConnectionTube (18) are the same as ConnectionFitting (2), DomedFittingBase (3), DomedMiddleBase (4), DomedCap (5) and ConnectionTube (7) shown in the FIG. 01.

WeldingBead-A (19) is a welding bead of ConnectionFitting (14) and DomedFittingBase (15). WeldingBead-B (21) is a welding bead of DomedFittingBase (15) and DomedMiddleBase (16). WeldingBead-C(23) is a welding bead of DomedMiddleBase (16) and DomedCap (17). WeldingBead-A (19), WeldingBead-B (21) and WeldingBead-C (23) are the welding beads of the inside surface of TankCapAssembly (13). It is not difficult to weld WeldingBead-A (19) because the thickness of ConnectionFitting (14) and DomedFittingBase (15) is not much different. It is not difficult to weld WeldingBead-B (21) because the thickness of DomedFittingBase (15) and DomedMiddleBase (16) is not much different. It is not difficult to weld WeldingBead-C(23) because the thickness of DomedMiddleBase (16) and DomedCap (17) is not much different. Airtight is demanded to Welding Bead-A (19), WeldingBead-B (21) and WeldingBead-C(23).

WeldingBeadVerticallyCut-A (20) is a welding bead of ConnectionFitting (14) and DomedFittingBase (15). WeldingBeadVerticallyCut-A (20) is the welding bead that is welded outside of TankCapAssembly (13). Airtight is not necessarily demanded to WeldingBeadVerticallyCut-A (20). To be demanded on the WeldingBeadVerticallyCut-A (20) is to stand up vertically from the domed surface of DomedFittingBase (15). Because the welding bead of WeldingBeadVerticallyCut-A (20) forms a slope or a dome when it is welded. It is necessary to shave off the welding bead vertically after WeldingBeadVerticallyCut-A (20) is welded. The WeldingBeadVerticallyCut-A (20) after being cut down vertically becomes the convex prop of S-character spiral winding.

WeldingBeadVerticallyCut-B (22) is a welding bead of DomedFittingBase (15) and DomedMiddleBase (16). WeldingBeadVerticallyCut-B (22) is the welding bead that is welded outside of TankCapAssembly (13). Airtight is not necessarily demanded to WeldingBeadVerticallyCut-B (22). To be demanded on the WeldingBeadVerticallyCut-B (22) is to stand up vertically from the domed surface of DomedMiddleBase (16). Because the welding bead of WeldingBeadVerticallyCut-B (22) forms a slope or a dome when it is welded. It is necessary to shave off the welding bead vertically after WeldingBeadVerticallyCut-B (22) is welded. The WeldingBeadVerticallyCut-B (22) after being cut down vertically becomes the convex prop of S-character spiral winding.

WeldingBeadVerticallyCut-C(24) is a welding bead of DomedMiddleBase (16) and DomedCap (17). WeldingBeadVerticallyCut-C(24) is welding bead that is welded outside of TankCapAssembly (13). Airtight is not necessarily demanded to WeldingBeadVerticallyCut-C (24). To be demanded on the WeldingBeadVerticallyCut-C(24) is to stand up vertically from the domed surface of DomedCap (17). Because the welding bead of WeldingBeadVerticallyCut-C(24) forms a slope or a dome when it is welded. It is necessary to shave off the welding bead vertically after WeldingBeadVerticallyCut-C(24) is welded. The WeldingBeaderticallyCut-C(24) after being cut down vertically becomes the convex prop of S-character spiral winding.

Figure 4:
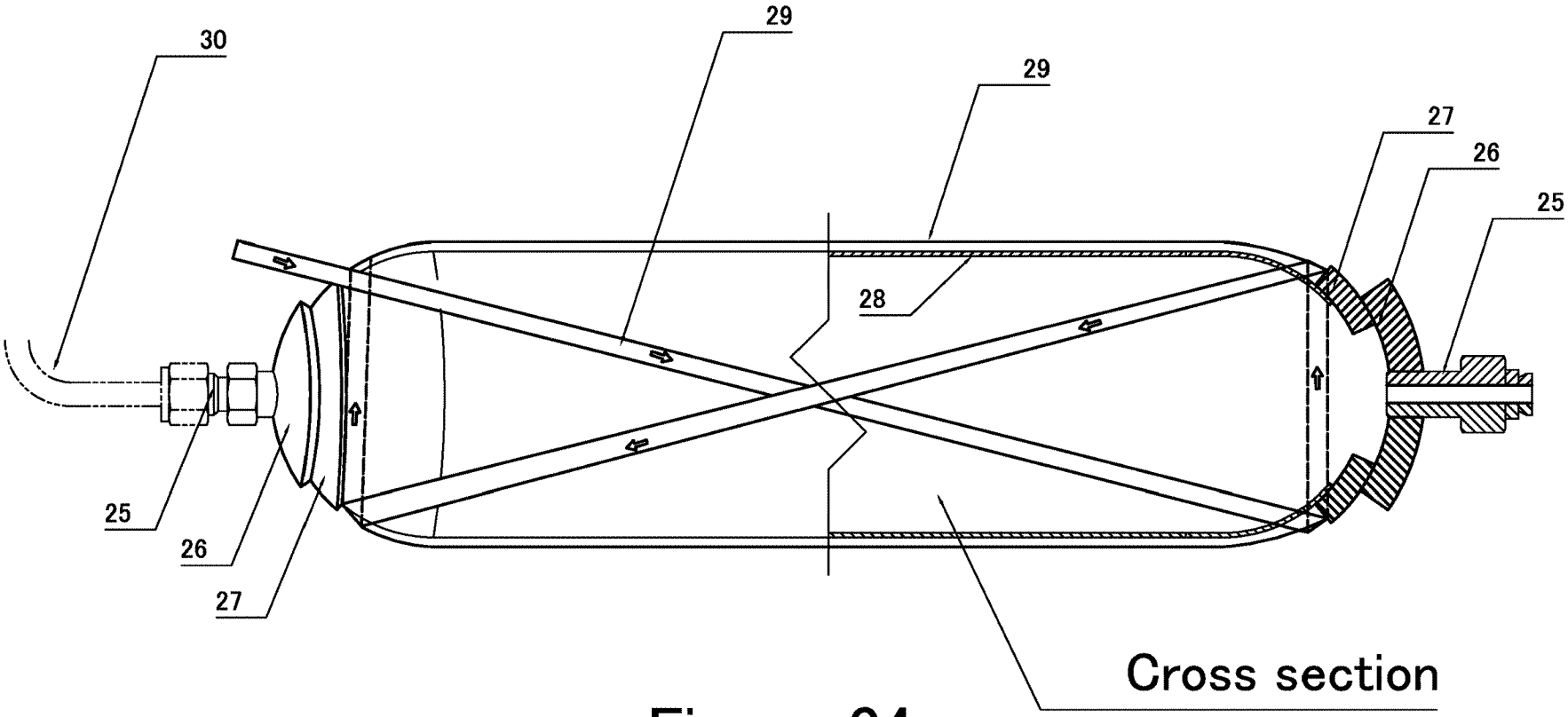
FIG. 04 shows a manufacturing process chart of Reinforcement Process Step One using the references of (25) ConnectionFitting, (26) DomedFittingBase, (27) DomedMiddleBase, (28) MetallicTank, (29)S-SpiralBandage-A, and (30) ConnectionTube.

FIG. 04 shows a manufacturing process chart of Reinforcement Process Step One. Reinforcement Process Step One is composed of ConnectionFitting (25), DomedFittingBase (26), DomedMiddleBase (27), MetallicTank (28), S-SpiralBandage-A (29), and ConnectionTube (30).

ConnectionFitting (25), DomedFittingBase (26), DomedMiddleBase (27) and ConnectionTube (30) are the same as ConnectionFitting (2), DomedFittingBase (3), DomedMiddleBase (4) and ConnectionTube (7) shown in the FIG. 01. MetallicTank (28) is a welded assembly of DomedCap (5) and StraightCylinder (6) shown in the FIG. 01.

S-SpiralBandage-A (29) in Reinforcement Process Step One is the first step for reinforcing the MetallicTankAssembly (1) shown in the FIG. 01. S-SpiralBandage-A (29) is a long and slender bandage of FRP prepreg. The FRP prepreg is made of carbon fiber, glass fiber, boron fiber and etc.

When a cylindrical tank is pressurized, two kinds of stresses are generated on tank wall. One is an axial stress and another one is a circumference stress. Reinforcement Process Step One is the reinforcement method resisting to axial stress. When S-SpiralBandage A (29) is wrapped winding to draw spiral S-character around both edges of DomedMiddleBase (27) the outside surface of MetallicTank (28) is completely covered with S-SpiralBandage-A (29). The edge of DomedMiddleBase (27) is WeldingBeadVerticallyCut-C (24) in FIG. 03. As the result, the hoop stress is generated in the S-SpiralBandage-A (29) because the S-SpiralBandage-A (29) is continuously winding around the outside surface of MetallicTank (28) many times. Hoop stress is tension stress. FRP prepreg can endure tension stress well.

It is not easy to roll the bandage axially on the surface of a long and slender cylinder tank. It is not necessary but preferable that both ends of the cylinder tank are domed. However, it is absolutely necessary that some prop should stand up at a domed center. The edge of DomedMiddleBase (27) does the role of the prop for MetallicTank (28). The edge of DomedMiddleBase (27) is WeldingBeadVerticallyCut-C(24) in FIG. 03. WeldingBeadVerticallyCut-C(24) is already standing up vertically from the domed surface of DomedCap (17). One or more props can be put up on the dome. Three props have been illustrated in FIG. 03. The first is WeldingBeadVerticallyCut-A (20), the second is WeldingBeadVerticallyCut-B (22) and the third is WeldingBeadVerticallyCut-C(24).

Figure 5:
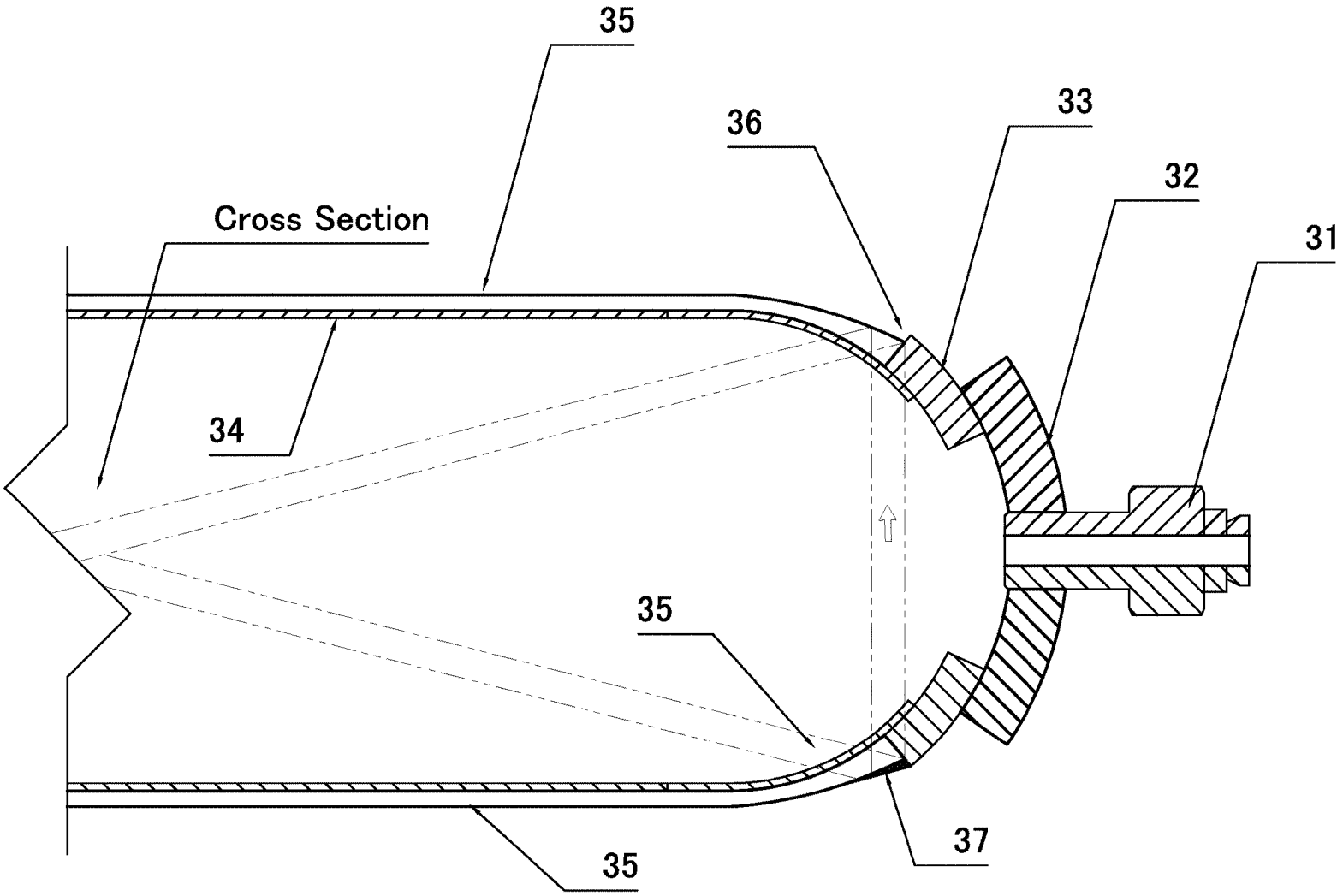
FIG. 05 shows a Detailed Chart Of Reinforcement Process Step One using the references of (31) ConnectionFitting, (32) DomedFittingBase, (33) DomedMiddleBase, (34) MetallicTank, (35)S-SpiralBandage-A, (36) PropGap-S1 and (37) HotBondMetalPowder-S1.

FIG. 05 shows a Detailed Chart Of Reinforcement Process Step One. Detailed Chart Of Reinforcement Process Step One is composed of ConnectionFitting (31), DomedFittingBase (32), DomedMiddleBase (33), MetallicTank (34), S-SpiralBandage-A (35), PropGap-S1 (36) and HotBondMetalPowder-S1 (37).

ConnectionFitting (31), DomedFittingBase (32), DomedMiddleBase (33), MetallicTank (34), S-SpiralBandage-A (35) are the same as ConnectionFitting (25), DomedFittingBase (26), DomedMiddleBase (27), MetallicTank (28), S-SpiralBandage-A (29) in FIG. 04.

Reinforcement by S-character spiral winding has a characteristic where the bandage of S-character spiral winding concentrates around a center prop. S-SpiralBandage-A (35) is winding around to draw spiral S-character at both edges of DomedMiddleBase (33). Therefore, S-SpiralBandage-A (35) concentrates on the neighborhood of the edge of DomedMiddleBase (33). As the result, the thickness of S-SpiralBandage-A (35) around the neighborhood of the edge of DomedMiddleBase (33) becomes thick compared with other place.

Outside surface of MetallicTank (34) is spirally covered with S-SpiralBandage-A (35). However, DomedFittingBase (32) and DomedMiddleBase (33) are not yet spirally covered with S-SpiralBandage-A (35). DomedFittingBase (32) and DomedMiddleBase (33) need to be reinforced by another bandage of S-character spiral winding. And, the height of DomedMiddleBase (33) is not necessarily equal to the height of a piled bandage of S-SpiralBandage-A (35). PropGap-S1 (36) is inevitably occurred somewhere at the edge of DomedMiddleBase (33).

PropGap-S1 (36) is a gap between WeldingBeadVerticallyCut-C(24), which is shown in FIG. 03, and S-SpiralBandage-A (35). PropGap-S1 (36) is very small. However, when this gap is left alone, a kink is generated in FRP prepreg. FRP prepreg is strong to a simple tension, but it is weak to kink. The gap between stair prop and S-character spiral bandage should be buried completely. It is desirable to bury this gap with a paste where a powder of carbon fiber or a glass fiber, metal powder is mixed with a thermoplastic bonding agent. Because the paste that is the mixture of thermoplastic bonding agent and powder of carbon or glass fiber, metal powder is a soft paste in room temperature when it is heated a little. And, it is merged with FRP prepreg by heat-treatment. Molding the paste is easy, because the paste becomes solid at room temperature. However, such a paste is not marketed. We have manufactured a compound of the thermoplastic resin and a metallic powder. The metallic powder that can be obtained now is an iron powder of 75 microns in the diameter. HotBondMetalPowder-S1 (37) is made from the compound of the thermoplastic resin and the metallic powder. The outline of HotBondMetalPowder-S1 (37) is actually a curve though it is drawn by straight line.

Figure 6:
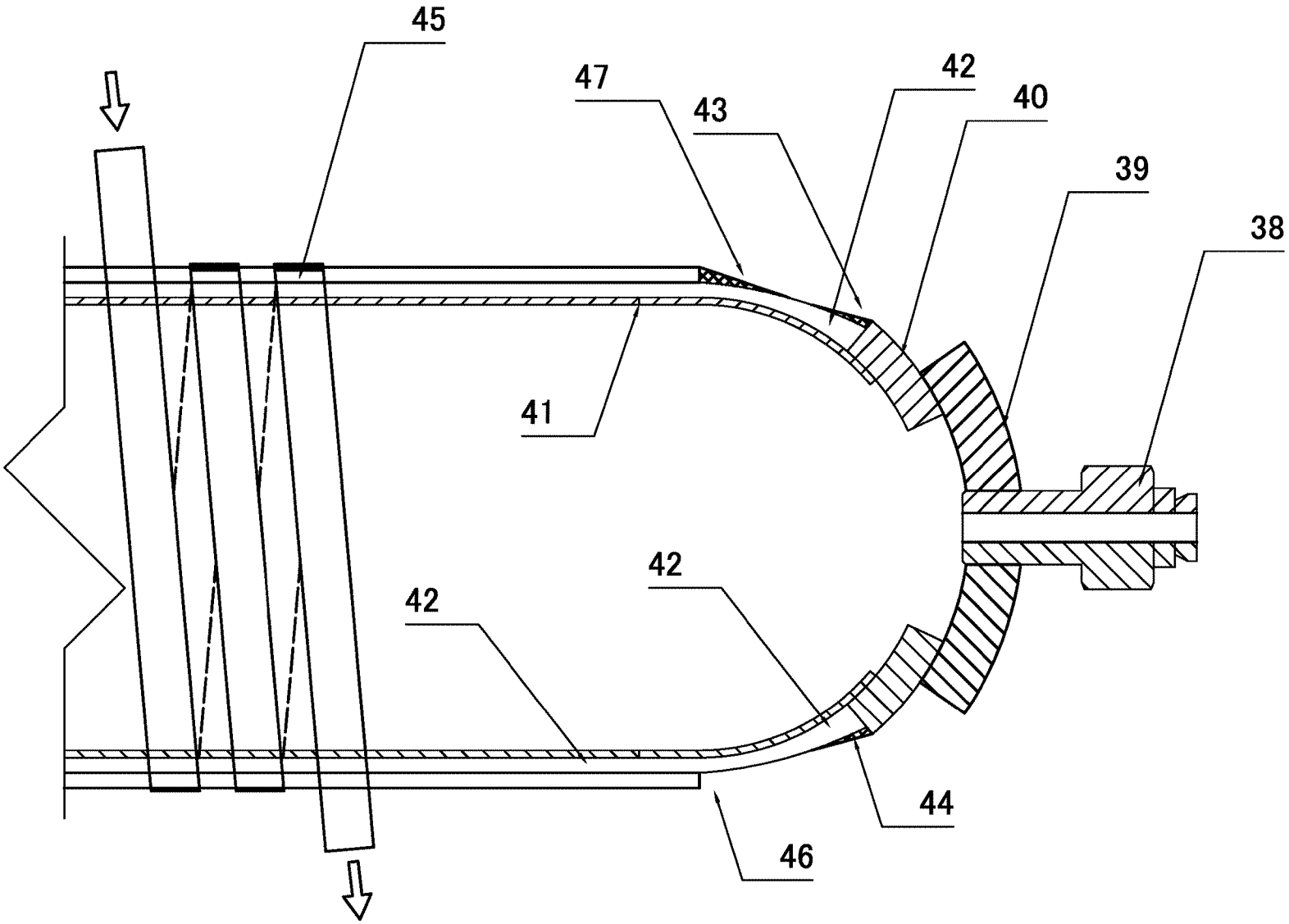
FIG. 06 shows a manufacturing process chart of Reinforcement Process Step Two using the references of (38) ConnectionFitting, (39) DomedFittingBase, (40) DomedMiddleBase, (41) MetallicTank, (42)S-SpiralBandage-A, (43) PropGap-S1, (44) HotBondMetalPowder-S1, (45) CircumferenceBandage-A, (46) StairDifference-C1 and (47) HotBondMetalPowder-C1.

FIG. 06 shows a manufacturing process chart of Reinforcement Process Step Two. Reinforcement Process Step Two is composed of ConnectionFitting (38), DomedFittingBase (39), DomedMiddleBase (40), MetallicTank (41), S-SpiralBandage-A (42), PropGap-S1 (43), HotBondMetalPowder-S1 (44), CircumferenceBandage-A (45), StairDifference-C1 (46) and HotBondMetalPowder-C1 (47).

ConnectionFitting (38), DomedFittingBase (39), DomedMiddleBase (40), MetallicTank (41), S-SpiralBandage-A (42), PropGap-S1 (43) and HotBondMetalPowder-S1 (44) are the same as ConnectionFitting (31), DomedFittingBase (32), DomedMiddleBase (33), MetallicTank (34), S-SpiralBandage-A (35), PropGap-S1 (36) and HotBondMetalPowder-S1 (37) in FIG. 05.

This invention and U.S. patent application Ser. No. 15/725,820 separately deal with the axial stress and the circumference stress. CircumferenceBandage-A (45) corresponds to the stress of the circumference.

(1) When long FRP prepreg bandage is rolling around S-SpiralBandage-A (42), the straight surface of S-SpiralBandage-A (42) is reinforced with the FRP prepreg bandage. The long FRP prepreg bandage rolling around S-SpiralBandage-A (42) is completely consecutive. As the result, a hoop stress is generated in the FRP prepreg bandage. Hoop stress is a tension stress. The FRP prepreg bandage endures the tension stress well. This long FRP prepreg Bandage is CircumferenceBandage-A (45).

(2) Generally speaking when manufacturing FRP material, structural strength becomes steady when the direction of the reinforcement fiber of FRP is orthogonalized. The direction of S-SpiralBandage-A (42) and CircumferenceBandage-A (45) is almost orthogonal. Therefore, it is preferable to wind around S-SpiralBandage-A (42) and CircumferenceBandage-A (45) alternately from the viewpoint of structural strength.

(3) S-SpiralBandage-A (42) and CircumferenceBandage-A (45) are independent each other. S-SpiralBandage-A (42) corresponds to the axial stress. CircumferenceBandage-A (45) corresponds to the circumference stress.

CircumferenceBandage-A (45) is ended at the domed line of S-SpiralBandage-A (42). As the result, a stair difference, which is StairDifference-C1 (46), is generated between S-SpiralBandage-A (42) and CircumferenceBandage-A (45). StairDifference-C1 (46) is generated like a circumference line. Actually, this stair difference is not so big. However, when this difference is left alone, a kink is generated in FRP prepreg. FRP prepreg is strong to a simple tension, but it is weak to kink. And, StairDifference-C1 (46) tends to grow as the diameter of a cylinder tank grows. It is necessary to bury the difference smoothly with some loading materials. However, such a paste is not marketed. We have manufactured a compound of the thermoplastic resin and a metallic powder. The metallic powder that can be obtained now is an iron powder of 75 microns in the diameter. HotBondMetalPowder-S1 (47) is made from the compound of the thermoplastic resin and the metallic powder. The outline of HotBondMetalPowder-S1 (47) is actually a curve though it is drawn by straight line.

Figure 7:
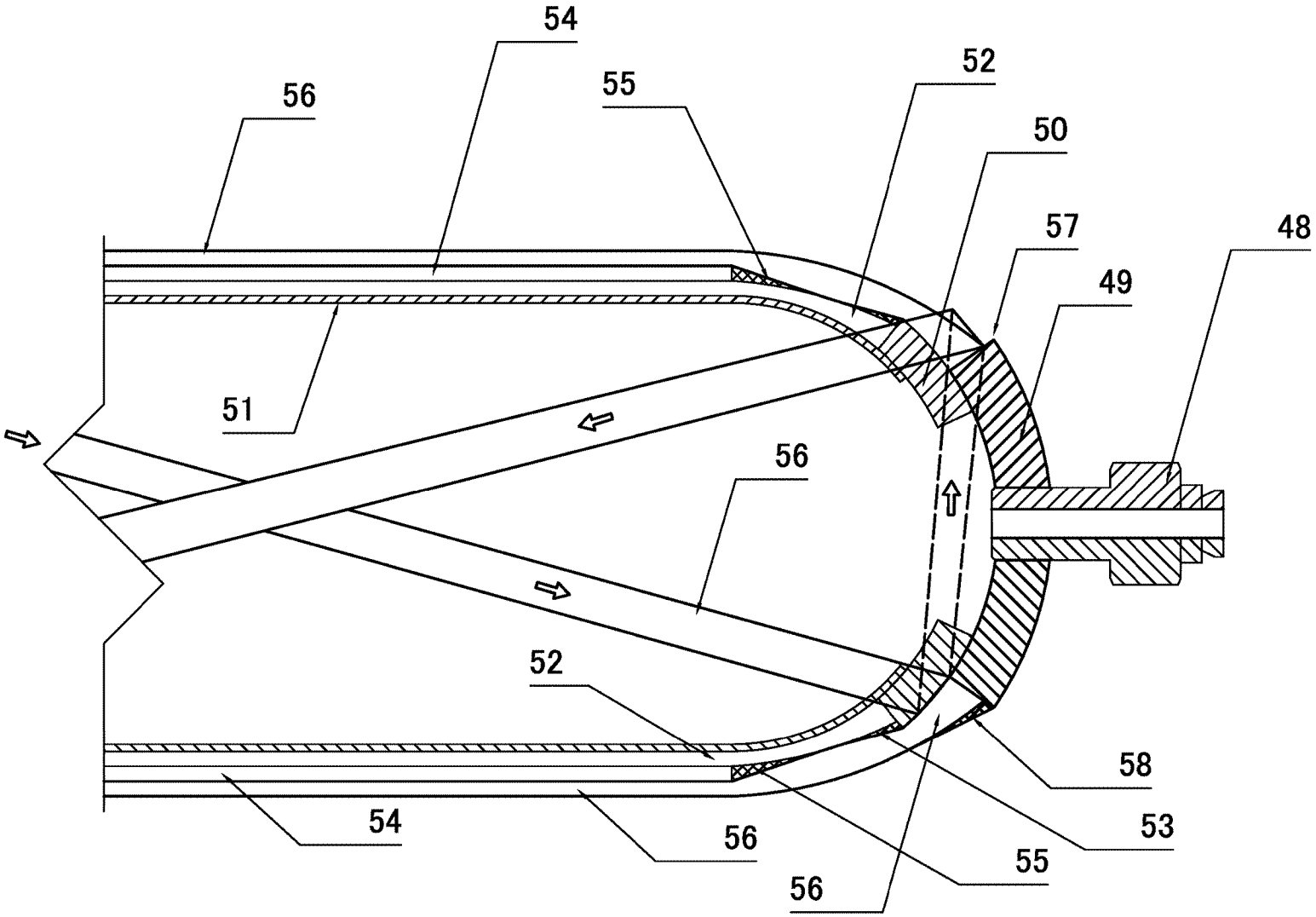
FIG. 07 shows a manufacturing process chart of Reinforcement Process Step Three using the references of (48) ConnectionFitting, (49) DomedFittingBase, (50) DomedMiddleBase, (51) MetallicTank, (52)S-SpiralBandage-A, (53) HotBondMetalPowder-S1, (54) CircumferenceBandage-A, (55) HotBondMetalPowder-C1, (56)S-SpiralBandage-B, (57) PropGap-S2 and (58) HotBondMetalPowder-S2.

FIG. 07 shows a manufacturing process chart of Reinforcement Process Step Three. Reinforcement Process Step Three is composed of ConnectionFitting (48), DomedFittingBase (49), DomedMiddleBase (50), MetallicTank (51), S-SpiralBandage-A (52), HotBondMetalPowder-S1 (53), CircumferenceBandage-A (54), HotBondMetalPowder-C1 (55), S-SpiralBandage-B (56), PropGap-S2 (57) and HotBondMetalPowder-S2 (58).

ConnectionFitting (48), DomedFittingBase (49), DomedMiddleBase (50), MetallicTank (51), S-SpiralBandage-A (52), HotBondMetalPowder-S1 (53), CircumferenceBandage-A (54), and HotBondMetalPowder-C1 (55) are the same as ConnectionFitting (38), DomedFittingBase (39), DomedMiddleBase (40), MetallicTank (41), S-SpiralBandage-A (42), HotBondMetalPowder-S1 (44), CircumferenceBandage-A (45), and HotBondMetalPowder-C1 (47) in FIG. 06.

In general, it is impossible to wind around S-character spiral after circumference rolling because circumference rolling is ended at the straight line of S-character spiral winding. This invention explains how it solves this problem with referring FIG. 05, FIG. 06 and FIG. 07.

A. FIG. 05

(1) PropGap-S1 (36) is a gap between WeldingBeadVerticallyCut-C(24) that is shown in FIG. 03 and S-SpiralBandage-A (35). PropGap-S1 (36) is smoothly buried by HotBondMetalPowder-S1 (37). HotBondMetalPowder-S1 (37) is actually a curve though it is drawn like a straight line in FIG. 05.

B. FIG. 06

(1) StairDifference-C1 (46) is a stair difference between S-SpiralBandage-A (42) and CircumferenceBandage-A (45). StairDifference-C1 (46) tends to grow as the diameter of a cylinder tank grows. It is necessary to bury the stair difference smoothly with some loading materials or HotBondMetalPowder because StairDifference-C1 (46) is sheer edge.

(2) HotBondMetalPowder-C1 (47) smoothly buries StairDifference-C1 (46). The outline of HotBondMetalPowder-C1 (47) is actually a curve though it is drawn like a straight line.

C. FIG. 07

(1) HotBondMetalPowder-S1 (37) in FIG. 05 is HotBondMetalPowder-S1 (53) in FIG. 07. HotBondMetalPowder-C1 (47) in FIG. 06 is HotBondMetalPowder-C1 (55) in FIG. 07. All gap and difference between Circumference-A (54) and S-SpiralBandage-B (56) are already buried by HotBondMetalPowder-S1 (53) and HotBondMetalPowder-C1 (55). It becomes possible to wind around S-character spiral after circumference rolling because all gap and difference are having been smoothly buried.

(2)S-SpiralBandage-B (56) is winding around on CircumferenceBandage-A (54), S-SpiralBandage-A (52), HotBondMetalPowder-C1 (55), HotBondMetalPowder-S1 (53) and DomedMiddleBase (50).

(3) The center convex prop is the outer edge of DomedFittingBase (49). The outer edge of DomedFittingBase (49) is the same as WeldingBeadVerticallyCut-B (22) in FIG. 03.

Under S-SpiralBandage-B (56), there exist MetallicTank (51) and DomedMiddleBase (50). DomedMiddleBase (50) is firmly bound to MetallicTank (51) by S-SpiralBandage-B (56). Reinforcement by S-character spiral winding has the characteristic where FRP prepreg bandage of S-character spiral winding concentrates around the center prop. S-SpiralBandage-B (56) concentrates on the neighborhood of the edge of DomedFittingBase (49). As the result, the thickness of S-SpiralBandage-B (56) on DomedMiddleBase (50) becomes thick compared with other place. Therefore, DomedMiddleBase (50) never blows off from MetallicTankAssembly (1), which is shown in FIG. 01, because of internal pressure.

However, the height of DomedFittingBase (49) is not equal to the height of concentrated bandage of S-SpiralBandage-B (56). PropGap-S2 (57) is inevitably occurred somewhere at the edge of DomedFittingBase (49). PropGap-S2 (57) is a gap between WeldingBeadVerticallyCut-B (22) that is shown in FIG. 03 and S-SpiralBandage-B (56). The characteristic of PropGap-S2 (57) is the same as PropGap-S1 (36) in FIG. 05. PropGap-S2 (57) is buried by HotBondMetalPowder-S2 (58). The characteristic of HotBondMetalPowder-S2 (58) is the same as HotBondMetalPowder-S1 (37) in FIG. 05.

Figure 8:
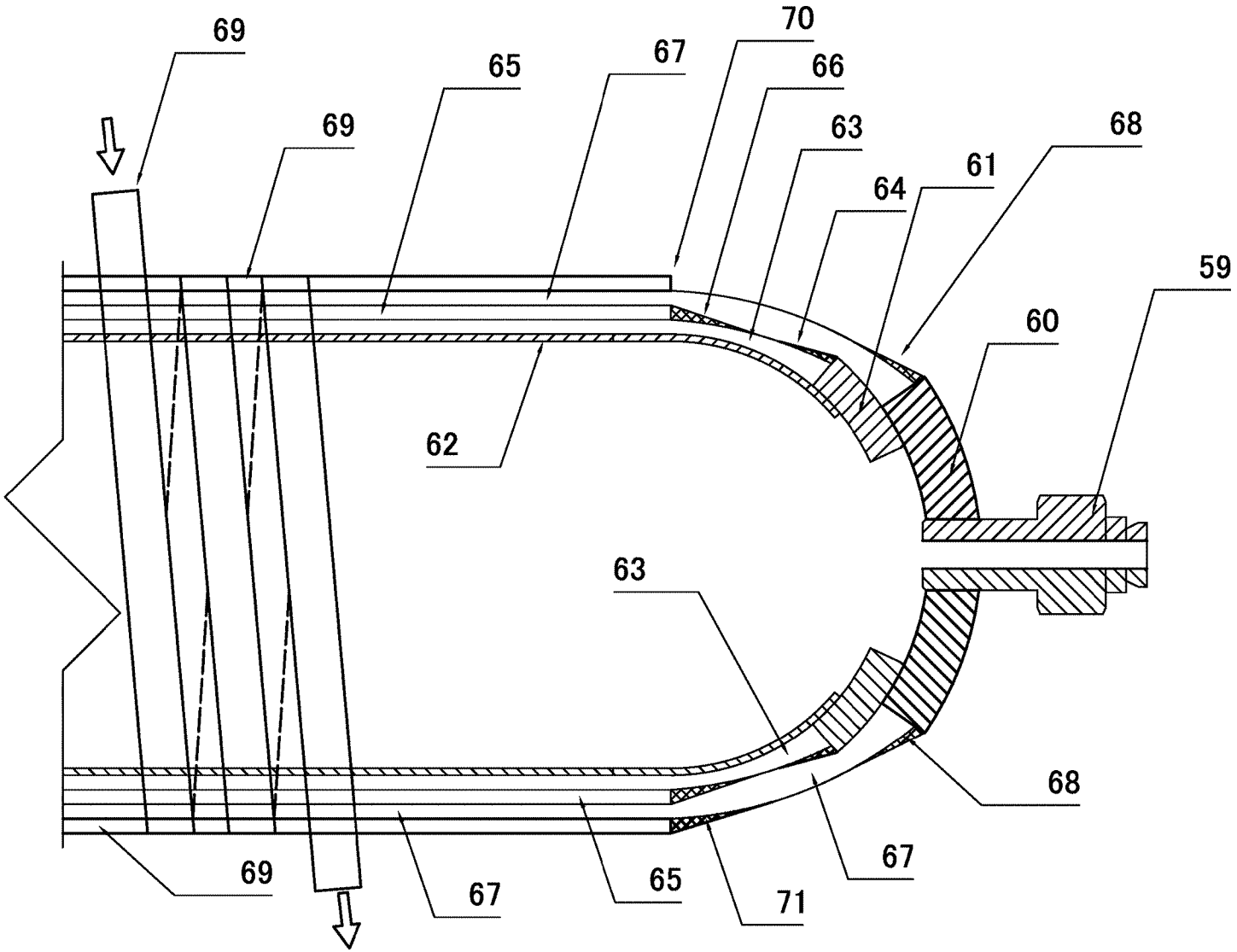
FIG. 08 shows a manufacturing process chart of Reinforcement Process Step Four using the references of (59) ConnectionFitting, (60) DomedFittingBase, (61) DomedMiddleBase, (62) MetallicTank, (63)S-SpiralBandage-A, (64) HotBondMetalPowder-S1, (65) CircumferenceBandage-A, (66) HotBondMetalPowder-C1, (67)S-SpiralBandage-B, (68) HotBondMetalPowder-S2, (69) CircumferenceBandage-B, (70) StairDifference-C2 and (71) HotBondMetalPowder-C2.

FIG. 08 shows a manufacturing process chart of Reinforcement Process Step Four. Reinforcement Process Step Four is composed of ConnectionFitting (59), DomedFittingBase (60), DomedMiddleBase (61), MetallicTank (62), S-SpiralBandage-A (63), HotBondMetalPowder-S1 (64), CircumferenceBandage-A (65), HotBondMetalPowder-C1 (66), S-SpiralBandage-B (67), HotBondMetalPowder-S2 (68), CircumferenceBandage-B (69), StairDifference-C2 (70) and HotBondMetalPowder-C2 (71).

ConnectionFitting (59), DomedFittingBase (60), DomedMiddleBase (61), MetallicTank (62), S-SpiralBandage-A (63), HotBondMetalPowder-S1 (64), CircumferenceBandage-A (65), HotBondMetalPowder-C1 (66), S-SpiralBandage-B (67) and HotBondMetalPowder-S2 (68) are the same as ConnectionFitting (48), DomedFittingBase (49), DomedMiddleBase (50), MetallicTank (51), S-SpiralBandage-A (52), HotBondMetalPowder-S1 (53), CircumferenceBandage-A (54), HotBondMetalPowder-C1 (55), S-SpiralBandage-B (56) and HotBondMetalPowder-S2 (58) in FIG. 07.

The purpose and the function of CircumferenceBandage-B (69) is the same as CircumferenceBandage-A (45) in FIG. 06. They correspond to the circumference stress of cylindrical tank. The characteristic of StairDifference-C2 (70) is the same as StairDifference-C1 (46) in FIG. 06. StairDifference-C2 (70) is buried by HotBondMetalPowder-C2 (71). The characteristic of HotBondMetalPowder-C2 (71) is the same as HotBondMetalPowder-C1 (47) in FIG. 06. This work can be repeated many times as the diameter of a cylinder tank grows. Therefore, this invention can be applied to a comparatively large-scale tank reinforced by FRP prepreg bandage.

Figure 9:
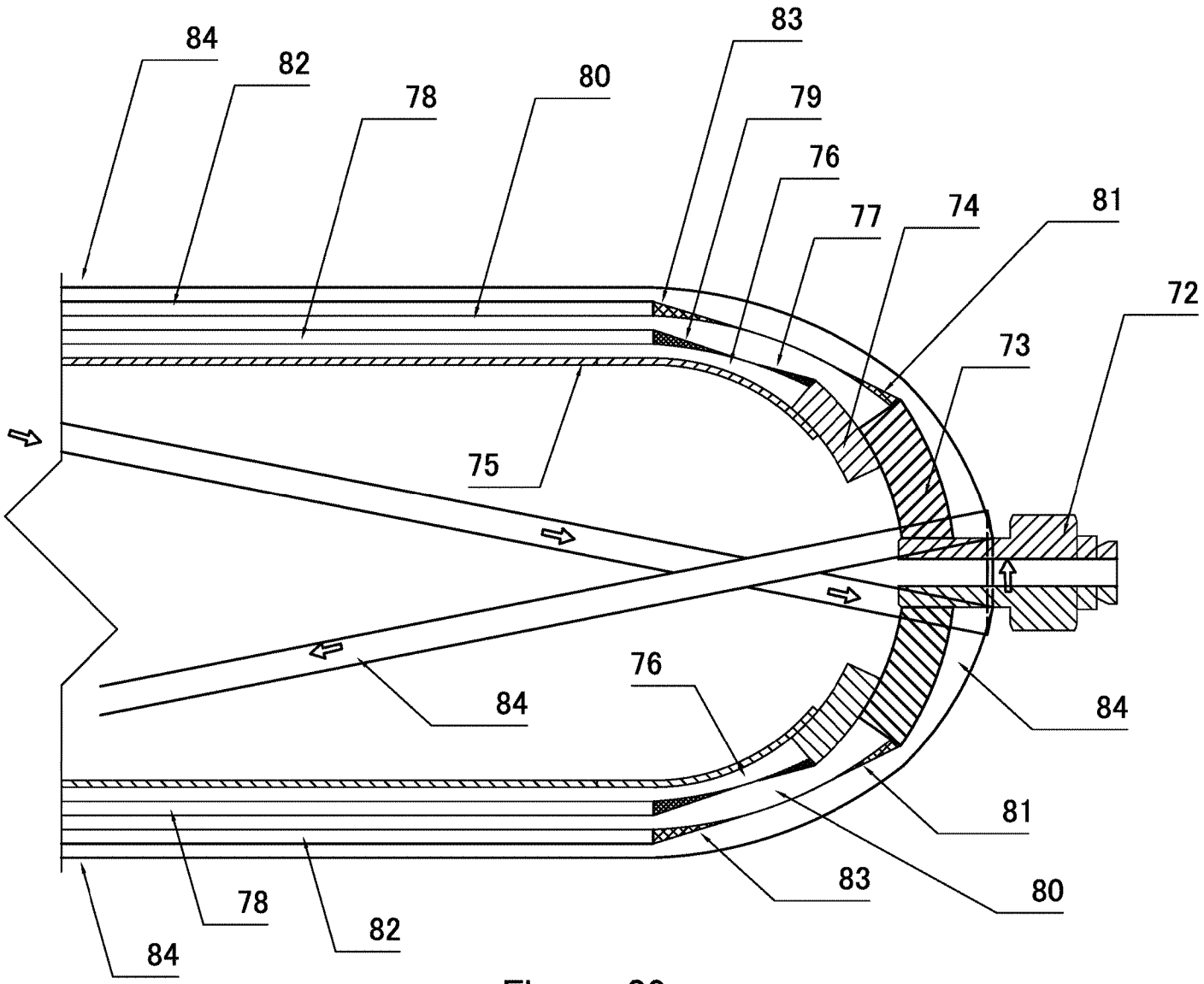
FIG. 09 shows a manufacturing process chart of Reinforcement Process Step Five using the references of (72) ConnectionFitting, (73) DomedFittingBase, (74) DomedMiddleBase, (75) MetallicTank, (76)S-SpiralBandage-A, (77) HotBondMetalPowder-S1, (78) CircumferenceBandage-A, (79) HotBondMetalPowder-C1, (80)S-SpiralBandage-B, (81) HotBondMetalPowder-S2, (82) CircumferenceBandage-B, (83) HotBondMetalPowder-C2, and (84)S-SpiralBandage-C.

FIG. 09 shows a manufacturing process chart of Reinforcement Process Step Five. Reinforcement Process Step Five is composed of ConnectionFitting (72), DomedFittingBase (73), DomedMiddleBase (74), MetallicTank (75), S-SpiralBandage-A (76), HotBondMetalPowder-S1 (77), CircumferenceBandage-A (78), HotBondMetalPowder-C1 (79), S-SpiralBandage-B (80), HotBondMetalPowder-S2 (81), CircumferenceBandage-B (82), HotBondMetalPowder-C2 (83), and S-SpiralBandage-C(84).

ConnectionFitting (72), DomedFittingBase (73), DomedMiddleBase (74), MetallicTank (75), S-SpiralBandage-A (76), HotBondMetalPowder-S1 (77), CircumferenceBandage-A (78), HotBondMetalPowder-C1 (79), S-SpiralBandage-B (80), HotBondMetalPowder-S2 (81), CircumferenceBandage-B (82), and HotBondMetalPowder-C2 (83) are the same as ConnectionFitting (59), DomedFittingBase (60), DomedMiddleBase (61), MetallicTank (62), S-SpiralBandage-A (63), HotBondMetalPowder-S1 (64), CircumferenceBandage-A (65), HotBondMetalPowder-C1 (66), S-SpiralBandage-B (67), HotBondMetalPowder-S2 (68), CircumferenceBandage-B (69), and HotBondMetalPowder-C2 (71) in FIG. 08.

The purpose and the function of S-SpiralBandage-C(84) is the same as S-SpiralBandage-B (56) in FIG. 07. S-SpiralBandage-C(84) is winding around CircumferenceBandage-B (82), S-SpiralBandage-B (80), HotBondMetalPowder-C2 (83), HotBondMetalPowder-S2 (81) and DomedFittingBase (73). The center convex prop is ConnectionFitting (72).

ConnectionFitting (72) is thick and solid connected fitting, which is marketed generally. ConnectionFitting (72) is welded firmly to DomedFittingBase (73). DomedFittingBase (73) is made of thick and solid stainless steel. ConnectionFitting (72) never blows off from DomedFittingBase (73) by internal pressure. The reason is that structural strength of ConnectionFitting (72) is designed to endure internal pressure of a high-pressure tank enough because the inside diameter of ConnectionFitting (72) is small. DomedFittingBase (73) is welded on the surface of medium thick DomedMiddleBase (74). The medium thick DomedMiddleBase (74) is welded on the thin wall of MetallicTank (75) that has little structural strength. A thick and solid connected fitting can be welded to the tank of lamina stainless steel by changing of thickness gradually.

Under S-SpiralBandage-C(84), there exist MetallicTank (75), DomedMiddleBase (74) and DomedFittingBase (73). DomedFittingBase (73) is firmly bound to MetallicTank (75) and DomedMiddleBase (74) by S-SpiralBandage-C(84). Reinforcement by S-character spiral winding has the characteristic where FRP prepreg bandage of S-character spiral winding concentrates around the center prop. S-SpiralBandage-C(84) concentrates on the neighborhood of ConnectionFitting (72). As the result, the thickness of S-SpiralBandage-C (84) on DomedFittingBase (73) becomes thick compared with other place. Therefore, DomedFittingBase (73) never blows off from MetallicTankAssembly (1), which is shown in FIG. 01, because of internal pressure.

Figure 10:
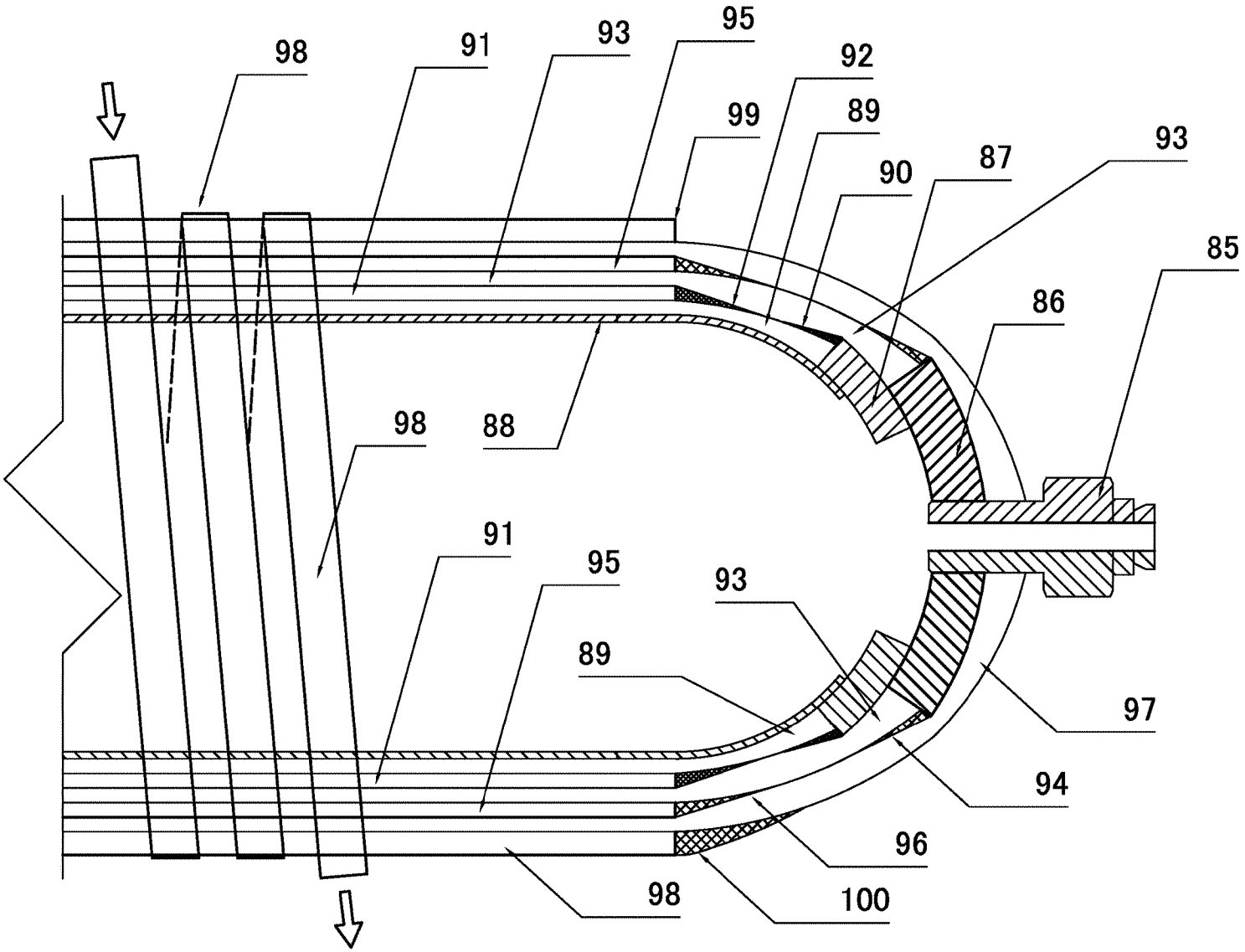
FIG. 10 shows a manufacturing process chart of Reinforcement Process Step Six using the references of (85) ConnectionFitting, (86) DomedFittingBase, (87) DomedMiddleBase, (88) MetallicTank, (89)S-SpiralBandage-A, (90) HotBondMetalPowder-S1, (91) CircumferenceBandage-A, (92) HotBondMetalPowder-C1, (93)S-SpiralBandage-B, (94) HotBondMetalPowder-S2, (95) CircumferenceBandage-B, (96) HotBondMetalPowder-C2, (97)S-SpiralBandage-C, (98) CircumferenceBandage-C, (99) StairDifference-C3, and (100) HotBondMetalPowder-C3.

FIG. 10 shows a manufacturing process chart of Reinforcement Process Step Six. Reinforcement Process Step Six is composed of ConnectionFitting (85), DomedFittingBase (86), DomedMiddleBase (87), MetallicTank (88), S-SpiralBandage-A (89), HotBondMetalPowder-S1 (90), CircumferenceBandage-A (91), HotBondMetalPowder-C1 (92), S-SpiralBandage-B (93), HotBondMetalPowder-S2 (94), CircumferenceBandage-B (95), HotBondMetalPowder-C2 (96), S-SpiralBandage-C(97), (98) CircumferenceBandage-C (98), StairDifference-C3 (99), and HotBondMetalPowder-C3 (100).

ConnectionFitting (85), DomedFittingBase (86), DomedMiddleBase (87), MetallicTank (88), S-SpiralBandage-A (89), HotBondMetalPowder-S1 (90), CircumferenceBandage-A (91), HotBondMetalPowder-C1 (92), S-SpiralBandage-B (93), HotBondMetalPowder-S2 (94), CircumferenceBandage-B (95), HotBondMetalPowder-C2 (96), and S-SpiralBandage-C(97) are the same as ConnectionFitting (72), DomedFittingBase (73), DomedMiddleBase (74), MetallicTank (75), S-SpiralBandage-A (76), HotBondMetalPowder-S1 (77), CircumferenceBandage-A (78), HotBondMetalPowder-C1 (79), S-SpiralBandage-B (80), HotBondMetalPowder-S2 (81), CircumferenceBandage-B (82), HotBondMetalPowder-C2 (83) and S-SpiralBandage-C(84) in FIG. 09.

The purpose and the function of CircumferenceBandage-C(98) is the same as CircumferenceBandage-B (69) in FIG. 08. They correspond to the circumference stress of cylindrical tank. The characteristic of StairDifference-C3 (99) is the same as StairDifference-C2 (70) in FIG. 08. StairDifference-C3 (99) is buried by HotBondMetalPowder-C3 (100). The characteristic of HotBondMetalPowder-C3 (100) is the same as HotBondMetalPowder-C2 (71) in FIG. 08. This work can be repeated many times as the diameter of a cylinder tank grows. Therefore, this invention can be applied to a comparatively large-scale tank reinforced by FRP prepreg bandage.

Figure 11:
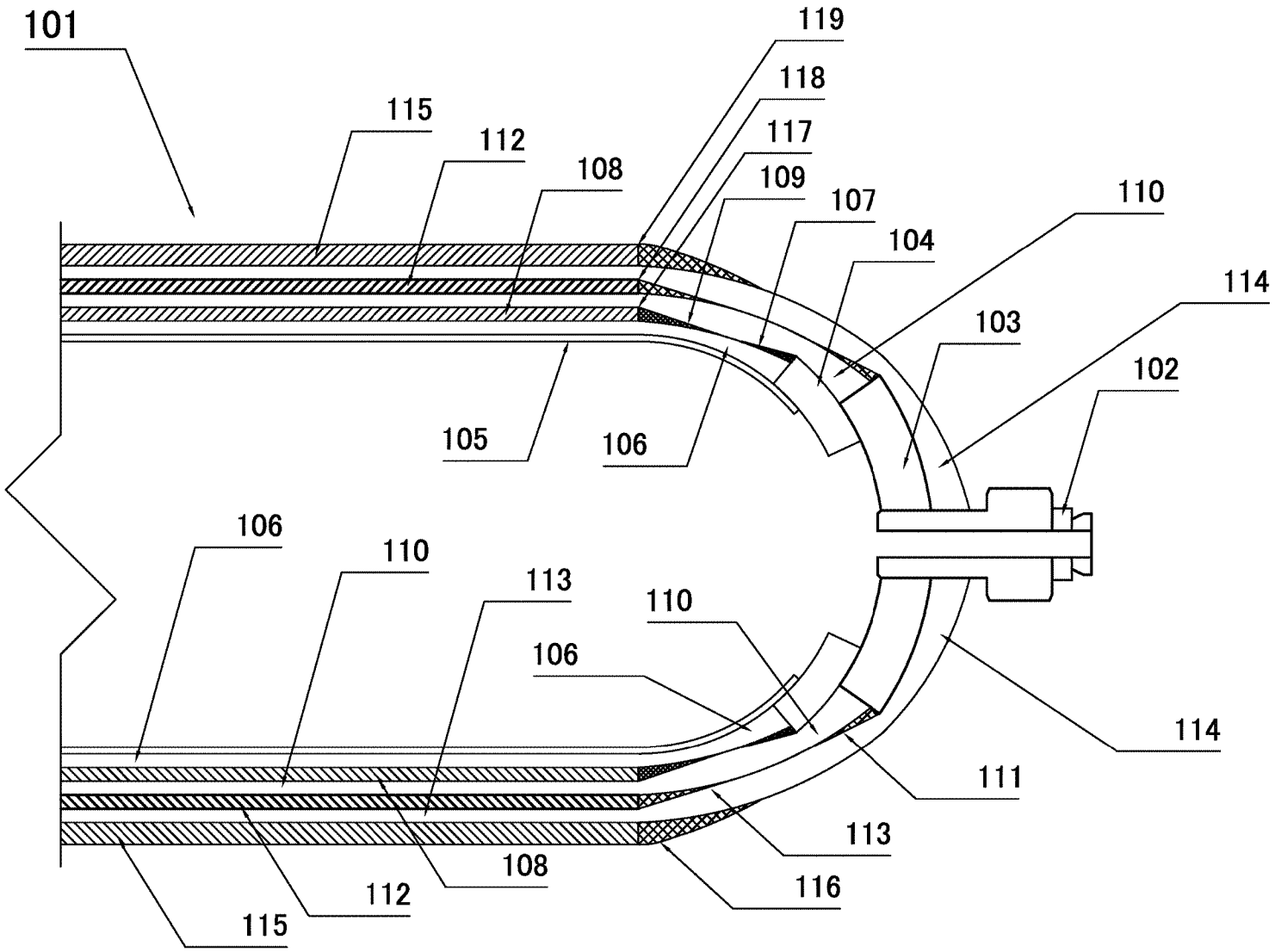
FIG. 11 shows a chart of ReinforcedMetallicTankAssembly (101) using the references of (102) ConnectionFitting, (103) DomedFittingBase, (104) DomedMiddleBase, (105) MetallicTank, (106)S-SpiralBandage-A, (107) HotBondMetalPowder-S1, (108) CircumferenceBandage-A, (109) HotBondMetalPowder-C1, (110)S-SpiralBandage-B, (111) HotBondMetalPowder-S2, (112) CircumferenceBandage-B, (113) HotBondMetalPowder-C2, (114)S-SpiralBandage-C, (115) CircumferenceBandage-C, (116) HotBondMetalPowder-C3, (117) StairDifference-C1, (118) StairDifference-C2, and (119) StairDifference-C3.

FIG. 11 shows a chart of ReinforcedMetallicTankAssembly (101). ReinforcedMetallicTankAssembly (101) is composed of ConnectionFitting (102), DomedFittingBase (103), DomedMiddleBase (104), MetallicTank (105), S-SpiralBandage-A (106), HotBondMetalPowder-S1 (107), CircumferenceBandage-A (108), HotBondMetalPowder-C1 (109), S-SpiralBandage-B (110), HotBondMetalPowder-S2 (111), CircumferenceBandage-B (112), HotBondMetalPowder-C2 (113), S-SpiralBandage-C(114), CircumferenceBandage-C (115), HotBondMetalPowder-C3 (116), StairDifference-C1 (117), StairDifference-C2 (118), and StairDifference-C3 (119).

ConnectionFitting (102), DomedFittingBase (103), DomedMiddleBase (104), MetallicTank (105), S-SpiralBandage-A (106), HotBondMetalPowder-S1 (107), CircumferenceBandage-A (108), HotBondMetalPowder-C1 (109), S-SpiralBandage-B (110), HotBondMetalPowder-S2 (111), CircumferenceBandage-B (112), HotBondMetalPowder-C2 (113), S-SpiralBandage-C(114), CircumferenceBandage-C (115), and HotBondMetalPowder-C3 (116) is the same as ConnectionFitting (85), DomedFittingBase (86), DomedMiddleBase (87), MetallicTank (88), S-SpiralBandage-A (89), HotBondMetalPowder-S1 (90), CircumferenceBandage-A (91), HotBondMetalPowder-C1 (92), S-SpiralBandage-B (93), HotBondMetalPowder-S2 (94), CircumferenceBandage-B (95), HotBondMetalPowder-C2 (96), S-SpiralBandage-C(97), CircumferenceBandage-C (98), and HotBondMetalPowder-C3 (100) in FIG. 10. StairDifference-C1 (117) is the same as StairDifference-C1 (46) in FIG. 06. StairDifference-C2 (118) is the same as StairDifference-C2 (70) in FIG. 08. StairDifference-C3 (119) is the same as StairDifference-C3 (99) in FIG. 10.

The weakest area in hemisphere part of cylindrical tank is well known. It is not a domed center but outer edge. Hemisphere part of cylindrical tank is reinforced only by 5-character spiral winding bandage. In another word, the hemisphere part is not reinforced by circumference rolling bandage around the cylindrical tank. And, reinforcement by S-character spiral winding has a characteristic where the carbon fiber prepreg bandage of S-character spiral winding concentrates on a center of dome. The domed outer edge, which is the weakest area of cylindrical tank, becomes sparse. In a word, the hemisphere part of cylindrical tank is not reinforced by FRP prepreg bandage of circumference rolling and it is not evenly reinforced by the bandage of S-character spiral winding. It is not easy to reinforce the hemisphere part of a cylindrical tank efficiently. This problem remarkably grows according to when the diameter of an internal tank becomes large.

Hemisphere part of cylindrical tank is not reinforced by circumference rolling bandage around the cylindrical tank. This invention explains this principle, referring to FIG. 11. ReinforcedMetallicTankAssembly (101) has three piles of circumference rolling bandage. They are CircumferenceBandage-A (108), CircumferenceBandage-B (112) and CircumferenceBandage-C(115). These piles of circumference-rolling bandage are ended at the domed line of MetallicTank (105), which is cylindrical tank. Therefore, the hemisphere part of cylindrical tank is not reinforced by circumference rolling bandage, even if high-pressure tank assembly has two or more piles of circumference rolling bandage.

Hemisphere part of cylindrical tank is reinforced only by S-character spiral winding bandage. However, usually, it is impossible to do repeating S-character spiral winding many times because S-character spiral winding needs a convex prop at its center. And, reinforcement by S-character spiral winding has a characteristic where FRP prepreg bandage of S-character spiral winding concentrates on a center of dome. In the prior art, the domed outer edge that is the weakest area of cylindrical tank is reinforced only once. And the bandage of S-character spiral winding does not evenly reinforce the hemisphere part of cylindrical tank. When a high-pressure tank of the large diameter is manufactured, this problem becomes a great stumbling block. This invention explains how to solve these problems, referring to FIG. 11.

ReinforcedMetallicTankAssembly (101) has three bandage piles of S-character spiral winding. They are S-SpiralBandage-A (106), S-SpiralBandage-B (110) and S-SpiralBandage-C (114). The reason is that, ReinforcedMetallicTankAssembly (101) has three convex props on the surface of hemisphere part. The hemisphere part is shown as TankCapAssembly (A13) in FIG. 03. These convex props are WeldingBeadVerticallyCut-A (20), WeldingBeadVerticallyCut-B (22), and WeldingBeadVerticallyCut-C(24). S-SpiralBandage-A (106) is winding axially around WeldingBeadVerticallyCut-C(24). S-SpiralBandage-B (110) is winding axially around WeldingBeadVerticallyCut-B (22). S-SpiralBandage-C(114) is winding axially around WeldingBeadVerticallyCut-A (20). Therefore, ReinforcedMetallicTankAssembly (101) reinforces the domed outer edge three times where it is well known that the area is the weakest area of cylindrical tank. The new technology can arbitrarily increase the S-character spiral winding in proportion to the diameter of a high-pressure tank.

Reinforcement by S-character spiral winding has a characteristic where FRP prepreg bandage of S-character spiral winding concentrates on a center of dome. This invention uses this characteristic of S-character spiral winding. S-SpiralBandage-A (106) concentrates around the outer edge of DomedMiddleBase (104), and has especially reinforced the domed cap of MetallicTank (105). S-SpiralBandage-A (106) prevents the hemisphere cap of MetallicTank (105) being destroyed by internal pressure. The domed cap of MetallicTank (105) is shown as DomedCap (5) in FIG. 01. S-SpiralBandage-B (110) concentrates around the outer edge of DomedFittingBase (103), and has especially reinforced DomedMiddleBase (104). S-SpiralBandage-B (110) prevents DomedMiddleBase (104) being blown off by internal pressure. S-SpiralBandage-C(114) concentrates around the outer edge of ConnectionFitting (102), and has especially reinforced DomedFittingBase (103). S-SpiralBandage-C(114) prevents DomedFittingBase (103) being blown off by internal pressure. Domed cap of MetallicTank (105) is the weakest area of cylindrical high-pressure tank because the domed cap of MetallicTank (105) corresponds to the outer edge of hemisphere of cylindrical tank. The domed cap of MetallicTank (105) is defended by S-SpiralBandage-A (106), S-SpiralBandage-B (110) and S-SpiralBandage-C (114), three times. This invention can efficiently reinforce the weakest area in a cylindrical high-pressure tank.

In addition, there is another reason that the prior art cannot do repeating S-character spiral winding many times. The height of convex prop is not equal to the height of a piled bandage of S-character spiral winding. Prop-gap is inevitably occurred somewhere at the edge of convex prop. The prop gap is very small. However, when this gap is left alone, a kink is generated in FRP prepreg. FRP prepreg is strong to a simple tension, but it is weak to kink. The explanation concerning prop-gap is performed in FIG. 05. The gap between convex prop and S-character spiral bandage should be buried completely. This invention explains how to solve this problem, referring to FIG. 11.

ReinforcedMetallicTankAssembly (101) has two prop gaps. These two prop gaps are buried smoothly by HotBondMetalPowder-S1 (107) and HotBondMetalPowder-S2 (111). It is desirable that HotBondMetalPowder-S1 (107) and HotBondMetalPowder-S2 (111) are a paste where a powder of carbon fiber or a glass fiber is mixed with a thermoplastic bonding agent. Because the paste that is the mixture of thermoplastic bonding agent and powder of carbon or glass fiber is a soft paste in room temperature when it is heated a little. Cutting down the paste with a file is also easy in room temperature. And, it is merged with FRP prepreg by heat-treatment. Molding the paste is easy, because the paste becomes solid at room temperature. However, such a filler paste is not marketed. We have manufactured a compound of the thermoplastic resin and a metallic powder. The metallic powder that can be obtained now is an iron powder of 75 microns in the diameter. When the amount of metallic powders increases, the volume change when melting becomes small. However, the viscosity of the paste becomes hard. It is preferable to process the paste to a cylinder shape, and to bury the gap while melting the paste bar with handy heating device. Temperature for melting does not change. The outlines of HotBondMetalPowder-S1 (107) and HotBondMetalPowder-S2 (111) are actually a curve though they are drawn by straight line.

It is desirable to wind around S-character spiral and circumference rolling alternately from the viewpoints of structural strength. However, in the prior art, it is impossible to repeat the S-character spiral winding and the circumference rolling alternately, because a stair difference is generated between the bandage of S-character spiral winding and the bandage of circumference rolling. This difference causes a kink in FRP prepreg fiber. The FRP prepreg fiber is weak to the kink. Therefore, the S-character spiral winding and the circumference rolling can be done only once. When the diameter of an internal tank grows, the only once method causes deterioration in structural strength. This invention explains how it repeats the S-character spiral winding and the circumference rolling two or more times.

ReinforcedMetallicTankAssembly (101) has three stair differences. The first difference is StairDifference-C1 (117). StairDifference-C1 (117) is the difference between S-SpiralBandage-A (106) and CircumferenceBandage-A (108). StairDifference-C1 (117) is buried with HotBondMetalPowder-C1 (109). The second difference is StairDifference-C2 (118). StairDifference-C2 (118) is the difference between S-SpiralBandage-B (110) and CircumferenceBandage-B (112). StairDifference-C2 (118) is buried with HotBondMetalPowder-C2 (113). The third difference is StairDifference-C3 (119). StairDifference-C3 (119) is the difference between S-SpiralBandage-C(114) and CircumferenceBandage-C (115). StairDifference-C3 (119) is buried with HotBondMetalPowder-C3 (116).

Ideally, it is desirable that HotBondMetalPowder-C1 (109), HotBondMetalPowder-C2 (113) and HotBondMetalPowder-C3 (116) are a paste where a powder of carbon fiber or a glass fiber is mixed with a thermoplastic bonding agent. However, such a filler paste is not marketed. We have manufactured a compound of the thermoplastic resin and a metallic powder. The metallic powder that can be obtained now is an iron powder of 75 microns in the diameter. The outlines of HotBondMetalPowder-C1 (109), HotBondMetalPowder-C2 (113) and HotBondMetalPowder-C3 (116) are actually a curve though they are drawn by straight line. Therefore, it becomes possible to repeat the S-character spiral winding and the circumference rolling alternately, because all stair differences generated between the bandage of S-character spiral winding and the bandage of circumference rolling are smoothly buried. When CircumferenceBandage-C (115) is rolled around most outside, HotBondMetalPowder-C3 (116) is not necessarily necessary.

It will be appreciated that modifications may be made in the present invention. This invention can efficiently reinforce the weakest area in a cylindrical high-pressure tank of comparatively large diameter.

The spirit of this invention is a technical advancement of U.S. Pat. No. 8,917,809 B2 and U.S. patent application Ser. No. 15/725,820. This invention shows a reinforcement method for a cylindrical high-pressure tank reinforced by FRP prepreg bandage, totally. For that purpose, this invention developed the manufacturing process for the internal metallic tank assembly where its diameter is comparatively large. It is effective for lightening weight of a high-pressure tank. Although the present invention has been fully described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A reinforced storage container for volatile gases, comprising:

a storage tank having first and second domed end portions and a main body portion, each of the first and second domed end portions having defined therein first and second open hole portions, respectively;

first and second middle bases fixedly formed to connect with peripheral portions of the first and second open hole portions;

first and second fitting bases fixedly formed to connect with inner peripheral portions of the first and second surround middle bases;

first and second connection fittings fixedly mounted on first and second domed ends of the first and second fitting bases, respectively, wherein the first and second fitting bases are fixedly formed to surround base portions of the first and second connection fittings;

a first prepreg reinforcing layer enclosing the storage tank, the first prepreg reinforcing layer including at least one elongated prepreg bandage wrapped in a spiral S-shaped form along an axial direction of the storage tank and extending to at least outer peripheral portions of the first and second middle bases of the storage tank;

a second prepreg reinforcing layer enclosing the storage tank over the first prepreg reinforcing layer, the second prepreg reinforcing layer including at least one elongated prepreg bandage wrapped circumferentially around the main body portion of the storage tank and on top of the first prepreg reinforcing layer;

a third prepreg reinforcing layer enclosing the storage tank, the third prepreg reinforcing layer including at least one elongated prepreg bandage wrapped in a spiral S-shaped form along an axial direction of the storage tank and extending over the first and second middle bases to at least outer peripheral portions of the first and second fitting bases of the storage tank and on top of the second prepreg reinforcing layer;

a fourth prepreg reinforcing layer enclosing the storage tank over the second prepreg reinforcing layer, the fourth prepreg reinforcing layer including at least one elongated prepreg bandage wrapped circumferentially around the main body portion of the storage tank and on top of the third prepreg reinforcing layer;

a fifth prepreg reinforcing layer enclosing the storage tank over the fourth prepreg reinforcing layer, the fifth prepreg reinforcing layer including at least one elongated prepreg bandage wrapped circumferentially around the main body portion of the storage tank and on top of the fourth prepreg reinforcing layer; and a sixth prepreg reinforcing layer enclosing the storage tank, the sixth prepreg reinforcing layer including at least one elongated prepreg bandage wrapped in a spiral S-shaped form along an axial direction of the storage tank and extending over the first and second fitting bases to the first and second connection fittings of the storage tank and on top of the fifth prepreg reinforcing layer.

2. A reinforced storage container according to claim 1, wherein the storage tank is made of metal.

3. A reinforced storage container according to claim 2, wherein the first and second middle bases are made of metal.

4. A reinforced storage container according to claim 1, wherein the first and second middle bases are welded to the storage tank.

5. A reinforced storage container according to claim 3, wherein the first and second fitting bases are made of metal.

6. A reinforced storage container according to claim 5, wherein the first and second fitting bases are welded to the first and second surround middle bases, respectively.

7. A reinforced storage container according to claim 1, wherein outer peripheral portions of the first and second middle bases fixedly connecting with the peripheral portions of the first and second open hole portions are filled with a paste formed from at least one of carbon fiber powder and glass fiber powder mixed with a thermoplastic bonding agent.

8. A reinforced storage container according to claim 1, wherein the peripheral portions of the first and second fitting bases fixedly connecting with the inner peripheral portions of the first and second surround middle bases are filled with a paste formed from at least one of carbon fiber powder and glass fiber powder mixed with a thermoplastic bonding agent.

9. A method for forming a reinforced storage container for volatile gases, comprising the steps of:

providing a storage tank having first and second domed end portions and a main body portion, each of the first and second domed end portions having defined therein first and second open hole portions, respectively;

forming first and second middle bases to fixedly connect with peripheral portions of the first and second open hole portions;

forming first and second fitting bases to fixedly connect with inner peripheral portions of the first and second surround middle bases;

mounting the first and second connection fittings fixedly on first and second domed ends of the first and second fitting bases, respectively, wherein the first and second fitting bases are fixedly formed to surround base portions of the first and second connection fittings;

forming a first prepreg reinforcing layer to enclose the storage tank by providing the first prepreg reinforcing layer with at least one elongated prepreg bandage wrapped in a spiral S-shaped form along an axial direction of the storage tank and extending to at least outer peripheral portions of the first and second middle bases of the storage tank;

forming a second prepreg reinforcing layer to enclose the storage tank over the first prepreg reinforcing layer by providing the second prepreg reinforcing layer with at least one elongated prepreg bandage wrapped circumferentially around the main body portion of the storage tank and on top of the first prepreg reinforcing layer;

forming a third prepreg reinforcing layer to enclose the storage tank by providing the third prepreg reinforcing layer with least one elongated prepreg bandage wrapped in a spiral S-shaped form along an axial direction of the storage tank and extending over the first and second middle bases to at least outer peripheral portions of the first and second fitting bases of the storage tank and on top of the second prepreg reinforcing layer;

forming a fourth prepreg reinforcing layer to enclose the storage tank over the second prepreg reinforcing layer by providing the fourth prepreg reinforcing layer with at least one elongated prepreg bandage wrapped circumferentially around the main body portion of the storage tank and on top of the third prepreg reinforcing layer;

forming a fifth prepreg reinforcing layer to enclose the storage tank over the fourth prepreg reinforcing layer by providing the fifth prepreg reinforcing layer with at least one elongated prepreg bandage wrapped circumferentially around the main body portion of the storage tank and on top of the fourth prepreg reinforcing layer; and forming a sixth prepreg reinforcing layer to enclose the storage tank by providing the sixth prepreg reinforcing layer with at least one elongated prepreg bandage wrapped in a spiral S-shaped form along an axial direction of the storage tank and extending over the first and second fitting bases to the first and second connection fittings of the storage tank and on top of the fifth prepreg reinforcing layer.

10. A method for forming a reinforced storage container according to claim 9, wherein the storage tank is made of metal.

11. A method for forming a reinforced storage container according to claim 10, wherein the first and second middle bases are made of metal.

12. A method for forming a reinforced storage container according to claim 11, wherein the first and second middle bases are welded to the storage tank.

13. A method for forming a reinforced storage container according to claim 11, wherein the first and second fitting bases are made of metal.

14. A method for forming a reinforced storage container according to claim 13, wherein the first and second fitting bases are welded to the first and second surround middle bases, respectively.

15. A method for forming a reinforced storage container according to claim 11, further comprising:

filling the outer peripheral portions of the first and second middle bases fixedly connecting with the peripheral portions of the first and second open hole portions with a paste formed from at least one of carbon fiber powder and glass fiber powder mixed with a thermoplastic bonding agent.

16. A method for forming a reinforced storage container according to claim 11, further comprising:

filling the peripheral portions of the first and second fitting bases fixedly connecting with the inner peripheral portions of the first and second surround middle bases with a paste formed from at least one of carbon fiber powder and glass fiber powder mixed with a thermoplastic bonding agent.

* * * * *